US009909802B2

(12) United States Patent
Manning et al.

(10) Patent No.: US 9,909,802 B2
(45) **Date of Patent: *Mar. 6, 2018**

(54) SMART STORAGE OF TEMPERATURE SENSITIVE PHARMACEUTICALS

(71) Applicant: TruMed Systems, Inc., La Jolla, CA (US)

(72) Inventors: Robert James Manning, San Diego, CA (US); Eugene Abraham Baker, Oakland, CA (US)

(73) Assignee: TRUMED SYSTEMS, INC., La Jolla, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/675,618

(22) Filed: Aug. 11, 2017

(65) Prior Publication Data

US 2017/0370637 A1 Dec. 28, 2017

Related U.S. Application Data

(63) Continuation of application No. 13/974,793, filed on Aug. 23, 2013, now Pat. No. 9,733,012.
(Continued)

(51) Int. Cl.
*F25D 29/00* (2006.01)
*F25B 45/00* (2006.01)

(52) U.S. Cl.
CPC ..... *F25D 29/008* (2013.01); *F25D 29/00* (2013.01); *F25D 2400/361* (2013.01);
(Continued)

(58) Field of Classification Search
USPC ..... 62/127, 129, 176.6, 236
See application file for complete search history.

(56) References Cited

U.S. PATENT DOCUMENTS 4,572,838 A * 2/1986 Lanier ..... A23B 4/08 426/643
4,785,969 A 11/1988 McLaughlin
(Continued)

FOREIGN PATENT DOCUMENTS

DE 102008046392 A1 3/2010
WO 02/068886 A1 9/2002
WO 2004/005817 A1 1/2004

OTHER PUBLICATIONS

Centers for Disease Control and Prevention (CDC), Guidelines for Maintaining and Managing the Vaccine Cold Chain, MMWR, 2003, 1023-1025, 52(42) doi: www.cdc.gov/mmwr/preview/mmwrhtml/mm5242a6.htm (6 pages).
(Continued)

*Primary Examiner* — Scott A Zare
*Assistant Examiner* — Reva R Danzig
(74) *Attorney, Agent, or Firm* — Acuity Law Group; Daniel M. Chambers

(57) ABSTRACT

A refrigerator and/or freezer unit and system for storing, monitoring, and maintaining a supply of temperature sensitive pharmaceutical products in compliance with regulatory requirements. The unit contains compartments for each product type in multiple controlled temperature zones with sensors and readers to track product status and content. A user interface device in communication with an application service provider provides the user with a secure access to the content of the unit and product information. The application service provider provides the user with web accessed optimal management of product inventory.

18 Claims, 15 Drawing Sheets

Related U.S. Application Data

(60) Provisional application No. 61/692,659, filed on Aug. 23, 2012.

(52) U.S. Cl.
CPC ..... *F25D 2500/06* (2013.01); *F25D 2700/08* (2013.01); *F25D 2700/12* (2013.01)

(56) References Cited

U.S. PATENT DOCUMENTS 5,502,944 A 4/1996 Kraft et al.
5,520,450 A 5/1996 Colson, Jr. et al.
5,566,856 A 10/1996 Fallen et al.
5,713,485 A 2/1998 Liff et al.
6,003,006 A 12/1999 Colella et al.
6,021,392 A 2/2000 Leser et al.
6,068,156 A 5/2000 Life et al.
6,116,461 A 9/2000 Broadfield et al.
6,204,763 B1 3/2001 Sone
6,283,322 B1 9/2001 Liff et al.
6,338,007 B1 1/2002 Broadfield et al.
6,339,732 B1 1/2002 Phoon et al.
6,467,285 B2 10/2002 Felder et al.
6,471,089 B2 10/2002 Liff et al.
6,490,502 B2 12/2002 Fellows et al.
6,499,270 B2 12/2002 Peroni et al.
6,581,395 B2 6/2003 Felder et al.
6,581,798 B2 6/2003 Liff et al.
6,658,322 B1 12/2003 Frederick et al.
6,688,123 B2 2/2004 Felder et al.
6,735,497 B2 5/2004 Wallace et al.
6,776,304 B2 8/2004 Liff et al.
6,814,255 B2 11/2004 Liff et al.
6,874,684 B1 * 4/2005 Denenberg ..... B65G 1/045 235/381
6,935,560 B2 8/2005 Andreasson et al.
6,941,762 B2 9/2005 Felder et al.
6,963,791 B1 11/2005 Frederick et al.
7,006,893 B2 2/2006 Hart et al.
7,009,840 B2 3/2006 Clark et al.
7,111,780 B2 9/2006 Broussard et al.
7,123,989 B2 10/2006 Pinney et al.
7,140,191 B2 11/2006 Lee et al.
7,140,542 B2 11/2006 Andreasson et al.
7,155,306 B2 12/2006 Haitin et al.
7,182,256 B2 2/2007 Andreasson et al.
7,196,625 B1 3/2007 Nguyen
7,228,198 B2 6/2007 Vollm et al.
7,232,066 B2 6/2007 Andreasson et al.
7,258,249 B1 8/2007 Frederick et al.
7,258,276 B2 8/2007 Linton et al.
7,262,698 B1 8/2007 Frederick et al.
7,263,410 B1 8/2007 Frederick et al.
7,263,501 B2 8/2007 Tirinato et al.
7,286,900 B1 10/2007 Frederick et al.
7,293,705 B2 11/2007 Linton et al.
7,349,858 B1 3/2008 McGrady et al.
7,463,947 B1 12/2008 Frederick et al.
7,467,093 B1 12/2008 Newton et al.
7,515,988 B1 4/2009 Frederick et al.
7,552,071 B2 6/2009 Tirinato et al.
7,564,349 B2 7/2009 Robey
7,591,421 B2 9/2009 Linton et al.
7,596,426 B2 9/2009 McGrady et al.
7,596,427 B1 9/2009 Frederick et al.
7,630,791 B2 12/2009 Nguyen et al.
7,648,321 B2 1/2010 Neeper et al.
7,668,998 B2 2/2010 Perisich et al.
7,685,026 B1 3/2010 McGrady et al.
7,689,316 B1 3/2010 Frederick et al.
7,689,317 B2 3/2010 McGrady et al.
7,716,935 B2 5/2010 Kim et al.
7,735,732 B2 6/2010 Linton et al.
7,751,932 B1 7/2010 Fedor et al.
7,766,242 B2 8/2010 Lunak et al.
7,775,056 B2 8/2010 Lowenstein
7,784,689 B2 8/2010 Linton et al.
7,793,842 B2 9/2010 Neeper et al.
7,805,217 B2 9/2010 Chudy et al.
7,844,362 B2 11/2010 Handfield et al.
7,860,724 B2 12/2010 Chudy et al.
7,860,727 B2 12/2010 Showalter et al.
7,861,540 B2 1/2011 Cloutier et al.
7,865,263 B2 1/2011 Spano, Jr. et al.
7,912,754 B2 3/2011 Tiriano et al.
7,917,375 B2 3/2011 Ohmura et al.
7,942,321 B2 5/2011 Linton et al.
7,967,199 B2 6/2011 Linton et al.
8,006,903 B2 8/2011 Braun et al.
8,025,228 B2 9/2011 Dearing et al.
8,036,773 B2 10/2011 Braun et al.
8,083,994 B2 12/2011 Neeper et al.
8,094,028 B2 1/2012 Braun et al.
8,099,339 B1 1/2012 Pinsonneault et al.
8,103,379 B2 1/2012 Biba et al.
8,111,159 B2 2/2012 Andreasson et al.
8,145,353 B1 3/2012 Cotner et al.
8,156,755 B2 4/2012 Murray et al.
8,170,714 B2 5/2012 Spano, Jr. et al.
8,176,747 B2 5/2012 Howard et al.
8,190,448 B2 5/2012 Bajars et al.
8,180,485 B2 6/2012 Reckelhoff
8,210,548 B1 7/2012 Agyemang
8,224,664 B1 7/2012 Louie et al.
8,231,053 B2 7/2012 Linton et al.
8,252,232 B2 8/2012 Neeper et al.
8,281,553 B2 10/2012 Kim
8,318,499 B2 11/2012 Fritchie et al.
8,407,068 B2 3/2013 Ohmura et al.
8,417,379 B2 4/2013 Chudy et al.
8,423,180 B1 4/2013 Frederick et al.
8,483,867 B2 7/2013 Braun et al.
2002/0023444 A1 2/2002 Felder et al.
2002/0179622 A1 12/2002 Mase
2004/0115101 A1 6/2004 Malin
2004/0222297 A1 11/2004 Dearing et al.
2006/0154642 A1 7/2006 Scannell
2006/0272351 A1 12/2006 Murray et al.
2007/0069018 A1 3/2007 Dearing et al.
2008/0052202 A1 2/2008 Bodin et al.
2008/0184719 A1 * 8/2008 Lowenstein ..... F25D 29/00 62/127
2009/0188272 A1 7/2009 Cloutier et al.
2009/0231132 A1 9/2009 Shoenfeld
2010/0086440 A1 4/2010 Fattinger et al.
2010/0196445 A1 * 8/2010 David ..... A61M 37/0015 424/443
2010/0275625 A1 11/2010 Lowenstein
2010/0300130 A1 * 12/2010 Shoenfeld ..... E05L 347/00 62/129
2010/0303590 A1 12/2010 Pedrazzini
2011/0304466 A1 12/2011 Bair et al.
2013/0199232 A1 8/2013 Natarajan et al.

OTHER PUBLICATIONS

IDBLUE, IDBLUE Introduces Next-Generation UHF Mobile RFID Reader for Smartphones and Tablets, 2015, doi: http://idblue.com/idblue-introduces-next-generation-uhf-mobile-rhd-reader-for-smartphones-and-tablets (1 page).
Lumidigm, Mercury Series OEM Module, 2011, doi: http://lumid1.hdev1.com/mercury-series-oem-module/ (2 pages).
Magtek®, MagTek Mini—Magstripe Card Reader—swipe, doi: http://www.magtek.com/V2/products/secure-card-reader-authenticators/mini.asp# (1 page).
Motorola, Symbol LS3008 Rugged Handheld Scanner Specification Sheet, 2012, doi: http://www.barcode-store.com/pdf/Is3008.pdf.
Sample Access Manager, "SAM", by Hamilton Company USA, 4970 Enerm, Way, Reno, Nevada 89502. Product Description available at http://hamilton-storage.com/automated-sample-storage/

(56) References Cited

OTHER PUBLICATIONS 20c-80c-biobankingflow-capacity Document accessed Mar. 7, 2014.
World Health Organization (WHO), WHO Expert Committee on Specifications for Pharmaceutical Preparations, WHO Technical Report Series 961, 2011, 1-440, 45th Report, doi: http://whqlibdoc.who.int/trs/WHO_TRS_961_eng.pdf?ua=1.

* cited by examiner

Fig. 3

| Product | QTY | EXP | TEMP |
|---|---|---|---|
| A | 5 | 2/13 | 5° |
| B | 6 | 2/12 | 5° |

Expiration Alert:
n Doses of Product A will expire in x days (mm/dd/yy)

Stockout Alert:
Product B is currently stocked out
(order placed on mm/dd/yy)

203

SMART STORAGE OF TEMPERATURE SENSITIVE PHARMACEUTICALS

RELATED APPLICATIONS

This application is a continuation of U.S. application Ser. No. 13/974,793 filed on Aug. 23, 2013, which claims priority from U.S. Provisional Application Ser. No. 61/692,659 filed on Aug. 23, 2012, entitled "Smart Storage of Temperature Sensitive Pharmaceuticals". Each of these applications cited above is hereby incorporated by reference in its entirety.

FIELD OF THE INVENTION

The present invention relates generally to storage and inventory management of temperature sensitive pharmaceuticals.

BACKGROUND OF THE INVENTION

Many pharmaceutical products are dependent upon proper storage of the product with temperature being one of the key parameters that determines if a product is to be administered or discarded as spoiled. Some pharmaceutical product formulations require a storage temperature of about 5° C. and lose effectiveness and potency when stored at temperatures below freezing while others require sub zero storage. Generally, effectiveness and potency are decreased with every freeze thaw cycle. This is especially true for immunobiologics such as vaccines.

Concern over the proper storage of vaccines and awareness that exposure of vaccines to temperatures outside the recommended ranges can have adverse effect on potency, thereby reducing protection from vaccine-preventable diseases, prompted the Centers for Disease Control and Prevention (CDC) to establish "Guidelines for Maintaining and Managing the Vaccine Cold Chain" (www.cdc.gov/mmwr/preview/mmwrhtml/mm5242a6.htm). The CDC emphasizes that administration of potent immunobiologics is not only dependent on an effective cold storage unit it also requires maintaining accurate temperature logs. Due to significant variability of temperatures within a compartment of a refrigerator it is recommended that temperatures be recorded near the actual container of the pharmaceutical several times per day. Vaccines stored outside of a recommended temperature range are to be immediately separated from the stock of effective vaccines so to avoid dispensing of ineffective product.

The high cost of biologic pharmaceuticals further highlights the need of a refrigerator/freezer unit for the storage of pharmaceuticals with accurately maintained temperature zones, sensors for the recordation of temperatures surrounding the pharmaceutical product, and an alert system that assures responsive transfer of product to alternate site in case of a unit malfunction or power failure and removal of expired and ineffective product. A further need arises to simplify the management of the unit and its contents and to maintain an optimal inventory of the pharmaceuticals. Therefore it is an object herein to provide a smart refrigerator system that ascertains proper storage of pharmaceuticals in compliance with regulatory requirements, simplifies management protocols, and further utilizing the data and information thus gained to maintain optimal levels of pharmaceutical stock.

SUMMARY OF THE INVENTION

Provided herein are a refrigerator and/or freezer unit and an inventory management system for the storage of pharmaceuticals in compliance with regulatory requirements.

Provided herein are a refrigerator and/or freezer unit and a system for storing, monitoring, and maintaining a supply of temperature sensitive pharmaceutical products. Also provided herein are a plurality of compartments for each temperature sensitive pharmaceutical product type located in at least one controlled, sensor monitored, temperature zone of the unit, a reader for the identification of the product, and a user interface device (UID), in communications with an application service provider (ASP).

The unit, system and methods provided herein include a data collection system wherein the UID and/or the ASP capture and store data, related to the refrigerator and/or freezer unit and the temperature sensitive pharmaceutical products stored within that includes: unit content, a product descriptor, product dispense and refill transactions, a reader scan of product, reader scan of compartments, compartment camera images, temperature sensor data, lock sensor data, login codes, biometric scans, system security and function status, and/or manually entered data. Also provided herein is a user interface at the unit that provides a user with secure access, via the UID, to the unit, unit content, and status and information including: product name, dosage, location, quantity, lot numbers, and expiration dates; compartment temperatures; alerts and order status; and/or internet access to further product information. The user can also manually enter information at the user interface. Further provided herein is an ASP, in a cloud based hosted environment that provides services including: server space for data and information storage; software for the management of the unit, its content, and information related to the unit and the products stored within; product and regulatory information resource; and/or unit maintenance resource.

The ASP provided software includes software to manage the inventory of temperature sensitive pharmaceuticals in compliance with regulatory requirements wherein the pharmaceuticals are selected from among a biologic, an immunobiologic, an antibody, a peptide, a protein, an enzyme, a hormone, a nucleic acid, a lipid, and a formulation and/or combination of any of the preceding thereof.

The refrigerator and/or freezer unit provided herein may be a smaller unit, equal to, less than about 34 inches tall, or a larger unit, above about 34 in tall, and include controlled temperature zones below and/or above 0° C. For example the at least one controlled temperature zone can be maintained between 2° C. and 8° C. or between minus 50° C. and minus 15° C. In some examples the unit includes a first temperature zone maintained between 2° C. and 8° C. and a second temperature zone maintained between minus 50° C. and minus 15° C. wherein preferably the first temperature zone maintained between 4° C. and 6° C. and a second temperature zone maintained between minus 40° C. and minus 17° C. The temperature is monitored within each compartment of the plurality of compartments and the temperature within each compartment is recorded in compliance with regulatory requirements and displayed on an external portion of the refrigerator. The temperature is monitored by temperature sensors located within the compartments and connected to a backup power supply wherein in the event or a power outage the temperature data is transmitted to the UID and when full power is restored to the ASP.

In yet another embodiment the temperature zone temperature is monitored by a plurality of temperature sensors to ascertain that the temperature within each compartment is maintained at the designated temperature.

In one exemplary embodiment, the refrigerator and/or freezer unit is equal to or less than about 34" tall and at least 4 compartments are located in the sub 0.degree. C. temperature zone and at least 8 compartments are located in the above 0.degree. C. temperature zone.

Further provided herein is refrigerator and/or freezer unit wherein the plurality of compartments fill each temperature zone and vary in size and number providing customization of the compartment configuration. The compartments may be available in at least two standard sizes, very in number from at least two containers per temperature zone, may contain only one type of product, one product type with one expiration date, or one product, and may be optionally labeled and/or color coded to denote differences between the products contained within.

The reader used to identify a pharmaceutical product can be implemented using a variety of technologies including, but not limited to, optical device, a magnetic device, a camera, RFID, barcodes reader, and a magnetic strip reader. In one exemplary embodiment the reader device may be implemented with a barcode reader wherein the barcode reader optically scans a product, decodes the signal, and transfers the product information to the UID. In yet another embodiment the reader is a camera wherein identification of product includes the following steps: the camera captures an image of the pharmaceutical product with barcode label; the image is transmitted to the UID; the UID transmits the image to the ASP; the ASP provided product identification software analyzes the image and generates a product descriptor; the product descriptor is stored within the ASP provided product database and is transmitted to the UID; the UID receives and adds the product descriptor to its current inventory database and updates the UID product information display. The product descriptor may include information contained in the barcode and manufacturer provided product information. The product descriptor record thus may include product name and dosage, lot numbers and associated expiration date, recommended temperature for storage, compartment location, storage temperature history, and internet links to manufacturer and/or Center for Disease Control and Prevention (CDC) information on the product. In yet another embodiment the reader is a camera associated with each compartment and is used to capture an image of all products within a compartment wherein the analysis of the image captured by the camera reader provides a count of the product within the compartment.

The refrigerator and/or freezer unit may be implemented with a UID that is a touch screen computing device, such as a tablet computer, connected to the refrigerator via a docking station, and may be connected to or embedded within the outer surface of the unit. The UID can maintain a connection to the internet via multiple routes such as a local internet, a wireless network (WIFI) and/or cell phone card embedded in the refrigerator unit. A UID home screen displays information on the status of the unit and its content. Exemplary information displayed includes product name, product quantity, nearest expiration date, current temperature of product compartment, alerts, and/or product order status. Further information about the product may be displayed by selecting the name of a specific product on the UID display and includes location by compartment, temperature history, lot numbers with associated expiration dates of current inventory, and links to product information on the internet that includes manufacturer and/or Centre for Disease Control and Prevention (CDC) product information.

At the user interface the user completes the capture of product transactional information by confirming a successful reader scan of the product being added to the unit, entering the product information manually, or by selecting on the UID screen, product to be removed from the unit.

In yet another embodiment an optionally activated security interface is provided wherein access to the UID and the refrigerator unit includes a login code verification and/or a biometric sensor scan wherein a biometric scan device may be a finger print identification device, a retinal scan identification device, a facial recognition device or a voice identification device.

Provided herein is a system wherein the ASP provided software functions include: analysis and storage of data, records, and information related to the unit; communicating with the UID and select recipients; generating alerts related to temperature, expiration dates, system health, network disruption, power disruption/loss and low stock; and providing an authorized user access to information and reports related to unit status, product information, regulatory requirements, inventory management, wherein the access is via a secure website customizable based on user profile. A service provider, using ASP provided software and servers in a cloud based hosted environment may include inventory management in compliance with regulatory requirements, system administration, alerting, and reporting.

The inventory management may include tracking of the inventory of products within the refrigerator and/or freezer unit and all product dispense and refill transactions, tracking the expiration date of each product, providing re-order messages, providing remove expired product messages; providing product is about to expire messages; and providing a product and regulatory information resource. The system administration may include monitoring the refrigerator and/or freezer unit location information; monitoring information related to the physical status of the unit comprising: function; power, temperature or latches sensor data; maintaining communication between UID, ASP, and cell card application layers; maintaining select user an optionally secure access to the unit and ASP; and facilitating unit maintenance. The alerting provides the delivery of alerting messages, to select recipients and/or the UID, related to events comprising: temperature of a compartment approaches or exceeds allowed temperature limits; a product stock is depleted or reached a low limit; a product expired or is to expire within select number of days; and power outage.

Further embodiments of the system provides alert, delivery to the UID and other customizable pre-determined locations such as specified phone numbers, computers and email addresses. The alert delivered to the UID on the refrigerator indicates the location of the deviation and generate a customizable audio and/or visual alert.

In yet another embodiment the ASP inventory management software determines if a product has reached its expiration date or is deemed to have lost potency due to compartment temperature fluctuations outside of the recommended range, and sends an alert that product has expired, instructing the user to remove the expired and/or ineffective product. Determining if product has reached its expiration date and/or lost potency includes: comparing current date to expiration date of product and if current date is on or post the expiration date, the product is expired; and determining if the temperature of compartment holding product exceeded allowed temperature limits for a time period greater than a select number of minutes the product is deemed to have lost potency.

Further the ASP inventory management software identifies product within select number of days prior to the expiration date and sends an alert to the UID and select recipients to prioritize use of the product or exchange/return the product for fresher product.

In a particular embodiment the ASP inventory management software monitors inventory levels of product within each compartment and when one or more products approach a predetermined re-order count of product a low stock alert is generated wherein a first customizable and unique audio and/or visual alert is generated when product stock is low and a second customizable and unique audio and/or visual alert is generated when a product reaches a zero inventory count. The predetermined re-order count of product is determined by the user or the ASP service using dispense rate data, quantity of product contained in manufacturer packaging and number of days required to receive ordered product.

In a further embodiment the ASP provided software analyzes the reader data received from the UID and in combination with information available from product manufacturer generates a product descriptor record that includes for example: product name and dosage; lot numbers with associated expiration date; recommended temperature for storage; and compartment number.

Also provided herein are ASP provided software applications related to product potency and inventory management including: product potency assessment based on storage temperature history and product expiration date; product potency review in compliance with regulatory requirements; current product inventory assessment based on reader captured data and UID manually entered data; product inventory dispensing assessment; product order requests, status and recommendations; and reports and data analytics including: stock and dispense transactions, product loss due to expiration or spoilage, and frequency of refills.

Further embodiment of the software applications function is customization of refrigerator unit variables including: unit size and refrigerator and/or freezer option; compartment number, size and label and/or color coding per product and temperature zone; secure or free access to unit; selection of users; establishing user profiles with customized level of access; unit alert message signal type, audio and or visual option; and recipients of alert messages.

In yet another embodiment the ASP secure website software generates a user profile for each user and provides each user with customized levels of access to the information and data associated with each unit. A user that includes refrigerator unit user, refrigerator unit managers, and refrigerator unit owners may have the following level of access: a user with access to unit content only; a user with access to unit content and order related information on the ASP web site; a user with access to unit content and all information related to the unit on the ASP web site; and a user with access to select product reports.

Provided herein are reports generated by the ASP provided software, available based on a user's profile and permission status, wherein user group includes: refrigerator unit users, managers, and owners; manufacturers; distributors; product representatives; physicians; and pharmacists. Reporting includes: providing an authorized user access to information and reports related to unit status, product information, regulatory requirements, or inventory management, wherein the access is via a secure website and customizable based on user profile.

For example a refrigerator unit user, manager and owner have access to reports related to their unit and the reports may include: current inventory of product with expiration dates; quantity of product used, by type of use and/or total use, for a selected time period such as day, week month year; product dispense rate and type by date, percentages of product dispensed to patient and percent product lost due to expiration, spoilage in unit, spoilage outside of unit; and alert reports detailing any inventory and/or temperature alerts that have been generated over a given period of time. The refrigerator unit user, manager and owner also have access to reports related to other units serviced by the ASP including: type and quantity of product dispensed to patient by location such as a local region defined by community or city, a state, and/or country within a selected time period; product usage rate and type by date, percentages of product dispensed to patient and percent product lost due to expiration, spoilage in unit, spoilage outside of unit; alert reports detailing any inventory and/or temperature alerts that have been generated over a given period of time.

A manufacturer of exemplary product A may have access to reports including: quantity of product A dispensed to patient by date and/or by location such as a local region defined by community or city, a state, and/or country; percentages of product dispensed to patient and percent product lost due to expiration, spoilage in unit, spoilage outside of unit for a selected location; number of units within select location or region distributing product "A"; and low stock of product "A" alerts per unit and/or region. A distributor and a product representative may have access to reports on their products including reports on: quantity of product dispensed to patient, expired, and or spoiled by date and/or by location such as a local region defined by community or city, a state, and/or country; percentages of product dispensed to patient, expired, and spoiled; and low stock alerts. And a pharmacist may have access to reports on their products and refrigerator and/or freezer unit stocked by their pharmacy wherein reports included are: quantity of product dispensed to patient, expired, and or spoiled by date and by refrigerator and/or freezer unit stocked by their pharmacy; percentages of product dispensed to patient, expired, and spoiled; and low stock alerts.

Other features and advantages of the invention will be apparent from the following description, drawings and claims.

BRIEF DESCRIPTION OF THE DRAWINGS

FIG. 3 shows an exemplary view of a UID display.

DETAILED DESCRIPTION OF THE INVENTION

Figure 1:
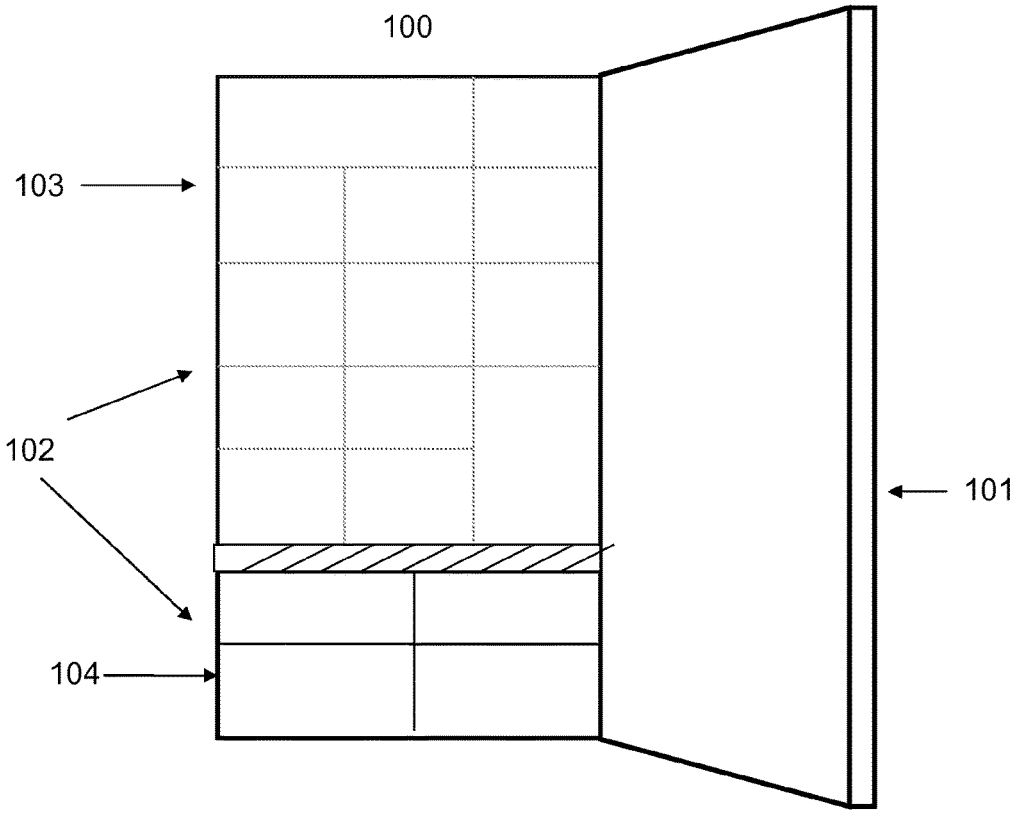
FIG. 1 shows an exemplary interior view of a refrigerator with a compartment configuration for two temperature zones.

The following detailed description illustrates an embodiment of the invention by way of example, not by way of limitation of the principles of the invention. Various embodiments of the invention will be described by way of illustration with reference to various software tools, but it should be understood that other software tools that have comparable capabilities of the mentioned tools may be used.

The contents of this Detailed Description are organized under the following headings: Definitions; Overview; Refrigerator Unit; User Interface device (UID); Reader; Application Service Provider (ASP); Alerts; and Inventory Management.

Definitions

Unless defined otherwise, all technical and scientific terms used herein have the same meaning as is commonly understood by one of skill in the art to which this invention belongs. All patents and publications referred to herein are, unless noted otherwise, incorporated by reference in their entirety. In the event a definition in this section is not consistent with definitions elsewhere, the definition set forth in this section will control.

As used herein, "refrigerator" refers to an appliance that cools the interior compartments to temperatures below the ambient temperature of the room, is designed for the storage of temperature sensitive pharmaceuticals in compliance with regulatory requirements, and is fitted with sensors, devices and a computer as described hereinafter. The refrigerator contains compartments above zero .degree. C. and may or may not provide a freezer compartment with temperatures below zero .degree. C. It is a low humidity, frost free, refrigerator with calibrated temperature monitoring sensors located at a point or points within the compartments which most accurately represents the temperature profile of the pharmaceutical product, is equipped with alarms to indicate temperature excursions and/or refrigeration failure, and has lockable doors meeting the guidelines of the World Health Organization (WHO), as described in "WHO Expert Committee on Specifications for Pharmaceutical Preparations", WHO technical Report Series 961, 2011 (Report found on www.who.int/en/)

As used herein, "freezer" refers to an appliance defined as is the refrigerator noted above with the exception of the inside of the unit cooled to a temperature below zero ° C.

As used herein, "smart refrigerator" refers to a refrigerator and/or freezer unit which contains a computer in communication with an ASP and is designed for storing, monitoring, and maintaining a supply of temperature sensitive pharmaceutical products as described herein.

As used herein, "compartment" refers to a holding container for a product designed to securely fit into the refrigerator and/or freezer unit and may take on a plurality of shapes including for example; a sliding drawer like structure wherein a drawer may contain further subdivisions forming smaller compartments; a tray like structure further holding individual trays designed to hold one product type which may come for example in the form of a vial, two vials, a syringe, or a package. The compartment design meets regulatory requirements and provides for a consistent temperature profile throughout the storage compartments when empty and in a normal filled condition.

As used herein, "cleanable surface" of a refrigerator is made of materials that are acceptable in a medical environment and can be cleaned and/or wiped with sterilization and/or cleaning chemicals and cloths as required by WHO regulation or best practice methods. The material is a durable, corrosion free material such as stainless steel, hard plastic or resin, and the surface is smooth with minimal number of seams.

As used herein, "Automatic Identification and Data Capture" (AIDC) refers to methods of automatically identifying objects using a device which collects data about the object and transfers the data directly into computer systems. Technologies typically considered as part of AIDC include bar code readers, Radio Frequency Identification (RFID), biometric scanners, magnetic strip reader, Optical Character Recognition (OCR), smart cards, and voice recognition.

As used herein, "reader" is a device used to obtain the identity of, and information related to, a specific product, using a method referred to as Automatic Identification and Data Capture (AIDC), by scanning, detecting, or capturing an image of a product in order to identify embedded information on the product.

As used herein, a "camera" may be used as a reader device to capture an image of a product with the portion displaying a barcode. The camera transfers the data to the ASP database via the UID computer, for analysis by barcode recognition software (see, e.g. Barcode Xpress available from accusoft at www.acusoft.com). The camera may also be used to capture an image of a compartment which is analyzed by the ASP provided software for the number of objects stored in a compartment using image recognition software available and known to those of skill in the art.

As used herein, "barcode" refers to an optical symbol, machine readable, containing information about the product on which it is displayed. The barcode may be one dimensional, a collection of bars of various widths representing the descriptive characters, two dimensional collection of symbols for example known as a Quick Response Code (QR), or three dimensional, where for example a 2D image includes color and further expands the amount of information captured.

As used herein, "barcode reader" refers to an electronic device specifically designed for reading printed barcodes. It consists of a light source, a lens and a light sensor translating optical impulses into electrical ones. Additionally, nearly all barcode readers contain decoder circuitry analyzing the barcode's image data provided by the sensor and sending the barcode's content to the scanner's output port (see, e.g., The LS3008 rugged handheld scanner by Motorola designed for the healthcare industry or the Motorola SE330X which can be integrated into a device, on the Motorola web site at www.motorola.com).

As used herein, "Radio-frequency identification" (RFID) refers to a reader that uses radio-frequency electromagnetic fields to transfer data from a tag attached to a product for the purposes of automatic identification and tracking. The tag does not require a battery as it is powered by the electromagnetic fields used to read them. The tag contains electronically stored information which can be read from up to several meters away. Unlike a bar code, the tag does not need to be within line of sight of the reader and may be embedded in the tracked object (see, e.g. UHF Mobile RFID Reader for Smartphones and Tablets, by IDBLUE at www.idblue.com).

As used herein, "magnetic strip reader" or "magnetic card reader" refers to a device with a guide for swiping and reading a magnetic card for example containing an access identification code of the designated user. Exemplary devices include MagTek Mini Swipe Magnetic Strip Reader, available from MAGTEK®. (see, e.g. magtek.com) where data is sent to the UID via a USB port and may be viewed in applications such as Windows®. Notepad without requiring additional drivers or application programming.

As used herein, "biometricreader" refers to a reader that uses for example a finger print or a retinal or facial recognition scan as a security measure to identify an authorized user of a refrigerator unit. For example a finger print recognition controlled access implements a finger print scanner, embedded in the user interface device, and software to analyze the scan. Scanners and software are readily available (see e.g. Mercury™. Series OEM Module from Lumidigm at www.lumidigm.com).

As used herein, "docking station" refers to a device that receives the user interface device. The docking station may serve only as a power source or may also be integrated directly into the other devices or systems such as temperature sensor, a reader, a camera, a biometric sensor or a central processing unit (CPU).

As used herein, "cell phone card" refers to a cellular network card which provides access to the internet. Cell phone cards are available and known to those of skill in the art.

As used herein, "user interface device" (UID) is a computer in communication with the refrigerator unit components and an ASP and is docked, or mounted, in a docking station connected to or embedded in the unit. The UID contains wired and wireless network adapter cards and remains fully functional when docked or undocked maintaining communications with the unit via a short range wireless communication device embedded in the unit. The UID, preferably a touch screen computer with a virtual onscreen keyboard, can access the internet via a wireless link to a local wireless network, a wireless communication through a cell phone card embedded in the unit, or a cable connection through a docking station. The UID contains an operating system and software required to capture data from sensors and readers on or within the refrigerator unit, send and receive data from an ASP, capture manually entered data, and display information.

As used herein, "tablet" refers to a self contained computer with a wireless internet connectivity that uses a touch screen with virtual keyboard capabilities for data access and entry.

As used herein, "Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

As used herein, "cloud-based host" refers to a third party provider server farm located in a centralized location, away from the individual refrigerator units, implemented as a service, maintaining communications with individual computers and users via the web. The data, software and programming are centralized on the server farm.

As used herein, "Application Service Provider" ("ASP") refers to a cloud-based hosted environment business that provides computer-based services to customers over a network. A user requires only a browser and an internet/intranet connection on their desktop, laptop, or other network access appliance to obtain substantially complete secure access to that system. Software offered using an ASP model is also sometimes called on-demand software or software as a service (SaaS) and may be accessed using standard protocol such as Hypertext Transfer Protocol (HTTP), foundation of data communication for the World Wide Web (see, e.g., ASP hosted services provided by NetSuite, Inc. of San Mateo, Calif. such as NetSuite™, Oracle®. Small Business Suite, NetCRM™, and NetERP™, descriptions of which can be found at www.netsuite.com).

The ASP utilizes one or more software application programs, routines or modules configured to be executed by a general purpose microprocessor, in one or more hardware devices, such as a programmable logic controller (PLC). The user benefits from having access to highly specialized software without the cost of purchasing, servicing and upgrading the software as well as access to ASP provided information and resources related to the products.

A used herein, "service provider" refers to a business that oversees and maintains the refrigerator/freezer system in all its functions as described herein.

As used herein a "product descriptor", refers to product information generated by the ASP provided software that combines the reader data received from the UID and information available from product manufacturer, information includes for example: product name and dosage, lot numbers and associated expiration date, recommended temperature for storage, and compartment location.

As used herein, "HL7" refers to a data format adapted by the healthcare industry for sharing information within the health care field. The document format is developed by Health Level Seven (HL7), a non-profit organization involved in the development of international healthcare informatics interoperability standards.

As used herein, "Electronic data interchange" or "EDI" refers to a data format adapted for communication between a healthcare provider and a vendor for example. EDI is the structured transmission of data between organizations by electronic means and without human intervention as defined by the National Institute of Standards and Technology.

As used herein, a "HIPPA" refers to "The Health Insurance Portability and Accountability Act of 1996" wherein it protects the privacy of individually identifiable health information; the HIPAA Security Rule, which sets national standards for the security of electronic protected health information.

As used herein, "regulatory requirements" refers to the regulations related to a refrigerator unit for storage of temperature sensitive pharmaceutical products as defined by the World Health Organization (WHO) qualification requirements for cold storage of Time and Temperature Sensitive Pharmaceutical Products (TTSPP) (see, "WHO Expert Committee on Specifications for Pharmaceutical Preparations", WHO technical Report Series 961, 2011 available at www.who.int/).

As used herein, a "web site" is a set of related web pages containing content such as text, images, video, audio, etc. A website is hosted on at least one web server, accessible via a network such as the Internet or a private local area network through an Internet address known as a Uniform Resource Locator. All publicly accessible websites collectively constitute the World Wide Web.

As used herein, "product type" refers to products of the same pharmaceutical composition and dosage and its packaging may come for example, in the form of a vial, two vials, a syringe, or a package.

As used herein, "par level" is a predetermined inventory level of a specific product. When ordering or re-ordering product the goal is to increase inventory to the predetermined par level. The predetermined par level takes into consideration the physical maximum quantity of the specific product that can be physically accommodated by the storage unit, the shelf life of the product, and historical product dispense records.

As used herein, "re-order point" is the inventory level at which a re-order message is generated. The re-order point takes into account lead time for dispense rate, order processing, and product delivery in order to avoid stocking out of the product. The re-order point quantity of product to be ordered is determined by the difference between current inventory and the predetermined par level.

As used herein, "critical low" is an inventory level whereby a re-order would not arrive in time to avoid a zero count of stock, "stock-out", based on expected dispense rate, and manual intervention such as placing an overnight shipping order may be required.

As used herein, "biologic" is a pharmaceutical product composed of sugars, lipids, peptides, proteins, nucleic acids or combinations of these substances and may be a vaccine, blood or a blood component, allergenic, somatic cell, gene therapeutic product, recombinant therapeutic protein or nucleic acid, or living cells that are used as therapeutics to treat diseases.

As used herein, "potency" is a measure of the pharmaceutical product activity expressed in terms of the amount required to produce an effect of given intensity. Exposure to improper storage temperatures may decrease potency of a pharmaceutical product due to decomposition and/or denaturation of the product and/or by destabilizing the formulation of the product.

As used herein, "effectiveness" refers to the ability of a pharmaceutical to produce a beneficial effect.

The "Centers for Disease Control and Prevention" (CDC), a division of Department of Health and Human Services, which among its many roles also provides guidelines for proper handling and storage of vaccines. The guidelines may be found at www.cdc.gov/mmwr/preview/mmwrhtml/mm5242a6.htm.

As used herein, "point of care" is a location at or near the location where the pharmaceutical product is administered to a patient. Locations may include a physician's office, a physicians practice group suite, a clinic, a pharmacy, and a hospital.

As used herein, "business hours" refer to a time period of the day when pharmaceuticals are administered to patients and the refrigerator unit is likely to be opened frequently.

Overview

Provided herein is a smart refrigerator unit and system for the secure storage of temperature sensitive pharmaceuticals at optimal temperatures designed to identify, track and maintain an inventory of the temperature sensitive pharmaceuticals at optimal levels and potency in compliance with regulatory requirements. The refrigerator unit compartments are dedicated to one product type and expiration date, or a single product, and may be customized by size and number. The compartments may be located within several temperature zones which may include zones above and below freezing, zero ° C. The refrigerator unit devices such as temperature sensors, readers, locking mechanism, and security features communicate with a user interface device, docked on the unit, via a direct hard wire link or a wireless connection. The UID controls access to the unit, collects data related to the status of the refrigerator and its inventory content, and communicates with an ASP provided software in a cloud based hosted environment for inventory and information management.

Refrigerator and/or Freezer Unit

A smart refrigerator unit in one exemplary embodiment is a smaller unit, under 34 inches tall, designed to fit under a counter within a point of care facility such as a physician's office, a clinic or an onsite pharmacy. The exemplary unit contains two temperature zones commonly recommended for the storage of biologic pharmaceuticals, a first cold temperature zone maintained between 2° C. and 8° C., and a second frozen temperature zone maintained between minus 15° C. and minus 50° C. The first temperature zone is maintained preferably between 3° C. and 7° C. and more preferably between 4° C. and 6° C. The second temperature zone is maintained preferably between minus 15° C. and minus 30° C., and more preferably between minus 15° C. and minus 25° C.

Each temperature zone is filled with compartments for holding product, customizable in number and size, from at least one compartments in the frozen temperature zone to at least four compartments in the cold temperature zone. The compartments slide in and out for ease of access, come in at least 2 standard sizes, and vary in width and height to accommodate various quantities and sizes of product. FIG. 1 shows an exemplary layout of an arrangement of customizable compartments 102 with 4 compartments located in the below 0° C. temperature zone 104 and 13 compartments located in the above 0° C. temperature zones 103. Each compartment is dedicated to one type of product and expiration date and may be optionally labeled and/or color coded to denote differences between products contained within.

The smaller unit described above, may further be implemented by dedicating the unit to only one temperature zone, for example above 0° C. storage or below 0° C. storage, to meet the needs of a point of care facility. Larger units, above a 34 in height in yet another implementation of the invention may be a preferred size for point of care facilities including for example, a hospital, a clinic and pharmacy. The larger unit may also be dedicated to above 0° C. storage, below 0° C. storage or a combination of multiple temperature zones. In one exemplary embodiment each compartment within the unit contains at least one temperature sensor which, in communication with the user interface device, provides a historical record of temperature for each product assigned to the compartment. The temperature of each compartment is monitored at a customizable frequency that meets regulatory requirements and may vary throughout the day based on the frequency of opening and closing of the unit. For example, the temperature may be monitored at least once every 10 minutes during regular office hours and at least every 30 minutes outside of regular business hours. The sensor is connected to a back-up power source, a battery, or optionally if the sensor is a wireless sensor it is powered by a battery.

In yet another embodiment the temperature of a plurality of small compartments, designed to hold one or several products, is monitored by a plurality of temperature sensors positioned throughout a unit temperature zone to ascertain temperature measurement is representative of the compartment temperature.

The temperature within each temperature zone is pre-set to a temperature within the recommended storage temperature range for the products stored within and is maintained within several degrees of that point. In the event of a power failure the temperature sensors have a back-up power source, a battery, and will continue to record and store temperature data. Temperatures of the various compartments are displayed on the UID docked on the external portion of the refrigerator. The compartment temperatures may also be displayed using a secondary device, for example a digital or LED display, embedded or mounted on the external portion of the refrigerator. During a power outage the locks to the unit may be disabled and a user may choose to transfer products to another cold storage device in the event of temperature deviations outside of the recommended range.

Each compartment may further have a designated camera used to capture an image of the compartment content. Analysis of the image using ASP provided reader software generates a count of the number of products contained in the compartment, wherein the image analysis is based on the number of objects in the image. Each compartment is dedicated to one product type and expiration date and therefore the count of products within a compartment also provides an accurate inventory count.

The unit is fully compliant with the World Health Organization (WHO) qualification requirements for cold storage of Time and Temperature Sensitive Pharmaceutical Products (TTSPP) (see, "WHO Expert Committee on Specifications for Pharmaceutical Preparations", WHO technical Report Series 961, 2011 available at www.who.int/). The unit is specifically designed for storage of TTSPP, is capable of maintaining the temperature range over the full range of annual ambient temp at a point of care facility, is equipped with alarms to indicate temperature excursions and/or refrigeration failure and is fitted with lockable doors and an access control system. The exterior and interior of the unit is made of materials that are cleanable with sterilization solutions. The unit has a consistent temperature profile throughout the storage compartments when empty and in a normal filled condition and is equipped with calibrated temperature sensors, accurate to ±0.5° C., capable of continuous recording. The sensors are located at points within the unit which most accurately represents the temperature profile of the TTSPP. The WHO specifications for a refrigerator unit address the physical requirements, noted above, as well as protocols and methods that validate the potency of the administered TTSPP. The WHO protocol specifications include keeping records of the temperature profile of each TTSPP stored, providing alerts when deviations occur and scheduling and completing regular maintenance of the unit. The smart refrigerator system provided software follows, performs and/or schedules the specified protocols.

User Interface Device (UID)

Figure 2:
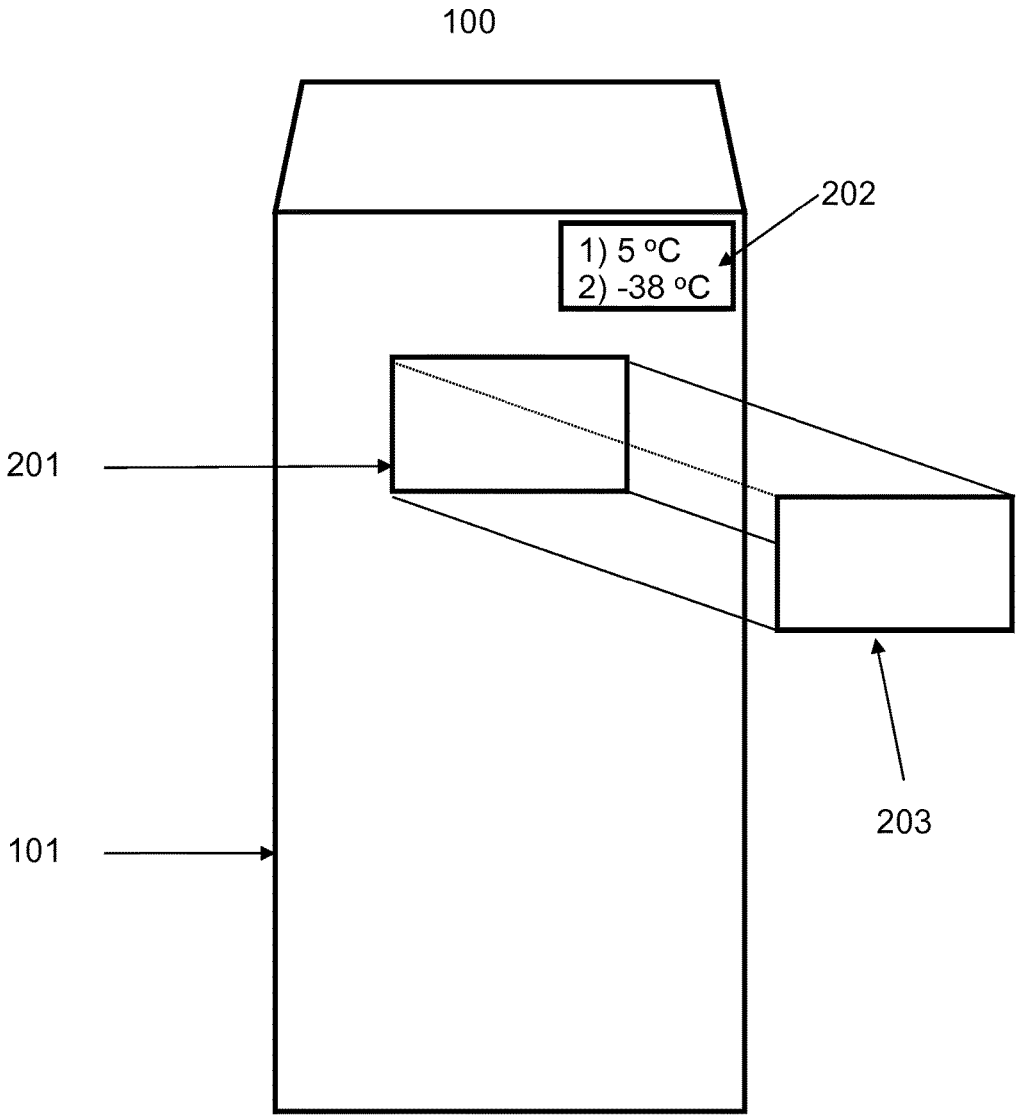
FIG. 2 shows an exemplary front exterior view of refrigerator.

A UID 203, preferably a tablet computer with a touchpad incorporated into the display, is docked in a docking station 201 embedded or connected to the front of the refrigerator unit. See FIG. 2. Communications between the UID and refrigerator unit is maintained via a hard wire connection to the central processing unit (CPU) of the smart refrigerator unit. The UID is the primary security interface providing a secure access to the unit and may use login code verification and/or a biometric image capture such as finger print identification, a retinal scan, a facial recognition, or a voice identification. A log in code may be a simple alphanumeric password that the user is either given or is provided an opportunity to enter a password that will be stored in the authentication server, located in the ASP database, in conjunction with the user account name. The user may also be prompted to enter a security question in the event the user forgets the password and needs to be issued a new password. The security feature may be optionally disabled The UID communicates with a cloud-based ASP via an internet connection through a local internet router, a wired or wireless network adapter card, or via a cellular network using a cell phone card, embedded in the unit. When the cell phone card is activated it updates information to the ASP at customizable number of minute intervals which may vary for periods during business hours, a period of frequent use of the unit, and periods outside of business hours when the unit remains closed.

A docking station connected to or embedded on the external portion of the unit provides a port for the UID and will primarily function as a link to the CPU and a power source for the UID. Other devices and sensors associated with the unit may communicate with or deliver data to the UID via the CPU or wirelessly. The docking station may in yet another embodiment provide a wired internet connection, a power source, and may integrate any wired sensors and devices, such as the temperature sensor and compartment cameras, with the UID. An RFID reader, a biometric sensor, a barcode or magnetic strip reader are other exemplary devices that can communicate with the UID wirelessly or be integrated with the UID via the docking station.

The UID uses a touch screen to display, enter and access information on the unit and its content. The default UID display includes: current temperatures, current product content with name and quantity of pharmaceuticals, nearest expiration date, alerts, and order status. By selecting the name of a specific pharmaceutical product on the UID screen further information about the pharmaceutical product is displayed including location by compartment, temperature history, lot numbers with associated expiration dates of current inventory; and links to manufacturer and/or Centers for Disease Control and Prevention (CDC) information on the pharmaceutical. FIG. 3 shows an exemplary display on the UID.

Reader

A reader in one embodiment is a device used to identify and/or count products present in the unit or being added to or removed from the unit. The reader device is embedded in, attached, and/or unattached to the unit and is in communication with the UID via a wired or wireless connection. Suitable reader devices are known to those skilled in the art and may be selected from various technologies including a camera, a radio frequency identification (RFID), barcode scanner, and or magnetic strip reader. Most pharmaceutical products, packaged individually or in groups by lot number, are labeled with a barcode by the manufacturer and therefore a barcode reader is preferred.

An exemplary reader is a camera which captures the image of a product, including a barcode label, and via the internet, wired or wireless, sends the image to the ASP for analysis. An ASP provided software analyzes the image obtaining product descriptor information which includes product name, dosage, lot number, and expiration date. The camera may be located on the UID and/or within or above the refrigerator compartment. A camera reader is a technology readily available, simple to use, and does not require special labeling of the product In yet another embodiment of the invention a barcode reader may also be utilized to identify a product. The barcode reader in this case contains decoder circuitry analyzing the barcode's image sending the information directly to the UID wherein the UID stores and also send the product information to the ASP to be added to a product database. The on-site user may scan the product being added to the unit with a handheld or an embedded reader wherein the information is transmitting to the UID via a wireless or a wired connection. The smart refrigerator unit may also be implemented with RFID technology by placement of an RFID reader, a two way radio transmitter-receiver wired to a transmitter, in communications with the UID which transfers the signal to the ASP provided RFID software to generate a product descriptor. The product in this case must be labeled with an RFID tag.

A reader in yet another embodiment is a biometric or magnetic strip device used as a security measure to identify an authorized user of the unit.

In embodiments using biometric authentication, some biometric information, such as a fingerprint image, is obtained and stored in the authentication server for use as the authentication credential. Such biometric information may be, but are not limited to, finger print images, spoken phrases for use in voice recognition, and facial images for use in facial recognition. In embodiments using finger print biometric information, users will have a fingerprint scanned to generate a fingerprint template that is stored in the authentication server. For other forms of biometric authentication, users may record a voice sample or have their retina scanned, with the resulting recording (or voice print) or image stored in the authentication server. For embodiments using facial recognition as a form of authentication, a camera may be employed to take detailed photographs of a user's face.

Figure 4:
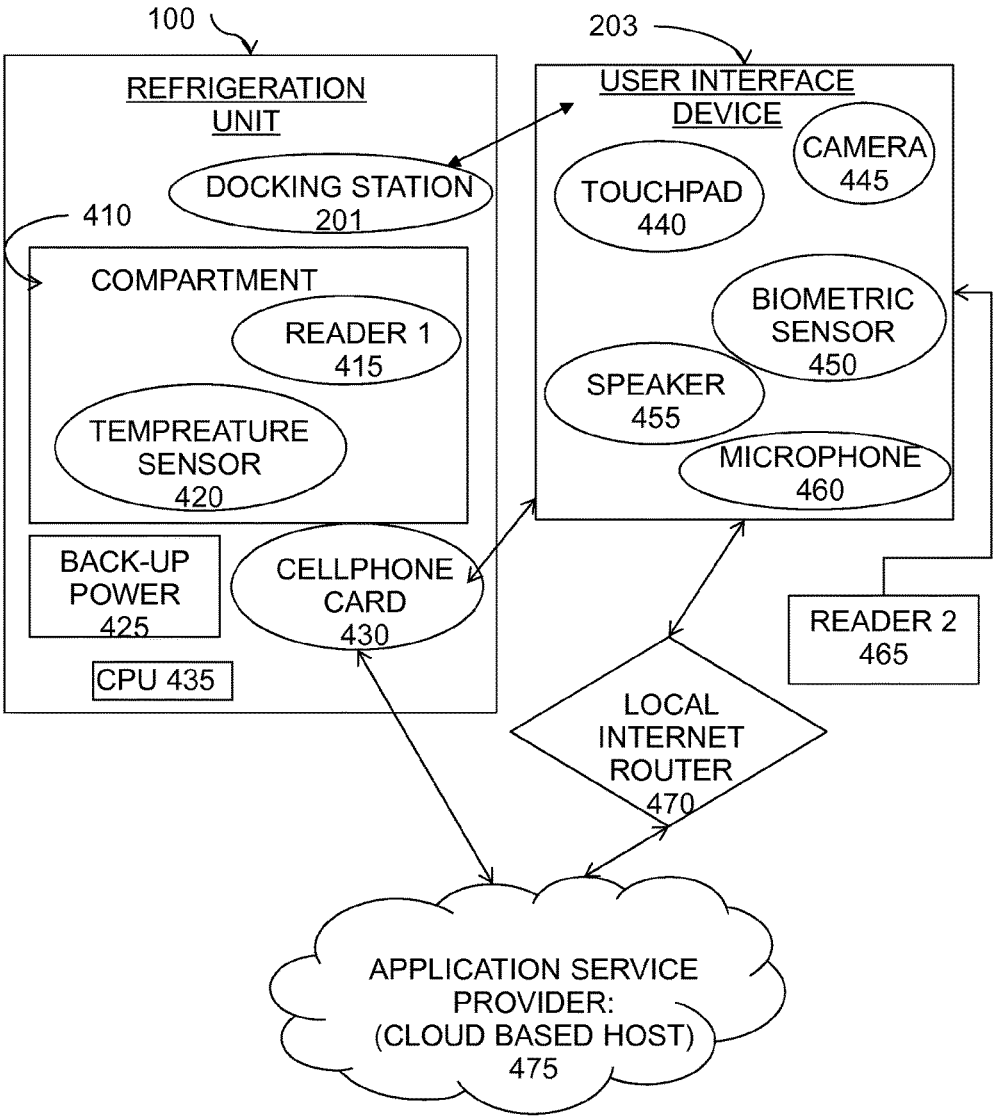
FIG. 4 is a block diagram overview of refrigerator system components.

FIG. 4 contains a block diagram overview of an exemplary refrigerator system and components. The unit 100 includes docking station 201, an exemplary compartment 410 further including an internal reader 1 415 and temperature sensors 420 connected to a backup power source 425, a cell phone card 430 in communication with a central processing unit (435). A UID 203 can be docked in the docking station includes a touch pad 440, a camera 445, a biometric sensor 450, a speaker 455, a microphone 460, and is connected to or in communication with an external reader 2 465. The UID is connected to a local internet router 470 which provides access to the cloud based ASP 475.

Figure 5:
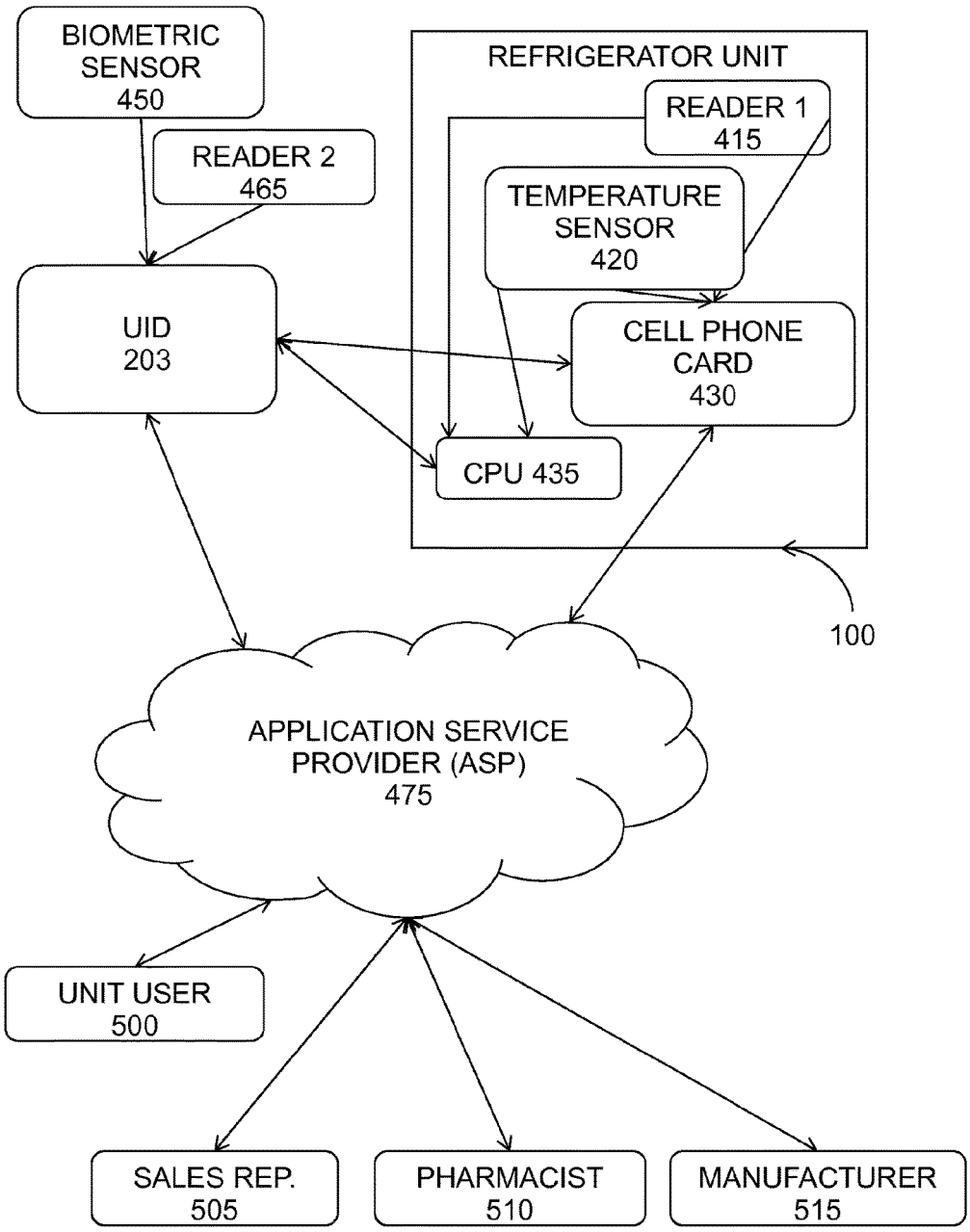
FIG. 5 is a flow diagram illustrating communication between refrigerator, UID and ASP.

FIG. 5 contains a block diagram overview of communication lines between components of an exemplary refrigerator system. Reader 1 415 and temperature sensor 420 communicate with CPU 435, The cell phone card 430 and CPU 435 in refrigerator unit 100 communicate with the UID 203 that also communicates with reader 2 465, biometric sensor 450, and ASP 475. Reader 1 415 and temperature sensor 420 may also communicate directly with and cell phone card 430 that is in communications with the ASP 475. The ASP 475 communicates, via a secure web site, with authorized users that include the unit user 500 and other non-unit users for example, a sales representative 505, a pharmacist 510 and a manufacture 515.

Application Service Provider (ASP)

The ASP, a cloud-based hosted environment, provides server space, to store and securely access data and information related to the unit, and software required to analyze and manage the data, information, and inventory.

The refrigerator unit data captured by the ASP inventory management software includes product dispense and refill transactions, product reader scans, temperature sensor data, manually entered information via the UID, camera images, and bioscans. The ASP software analyses and stores the data. The ASP product identification software provides a product descriptor record for each product which includes product name, dosage, lot number, expiration date, quantity of the product in the unit, recommended temperature for storage, unit/compartment location, special handling requirements and links to manufacturer and/or CDC information. The ASP further generates records related to dispense rate of product, spoilage frequency, historical temperature records, and product order frequency including average number of days required to receive new product.

Figure 6:
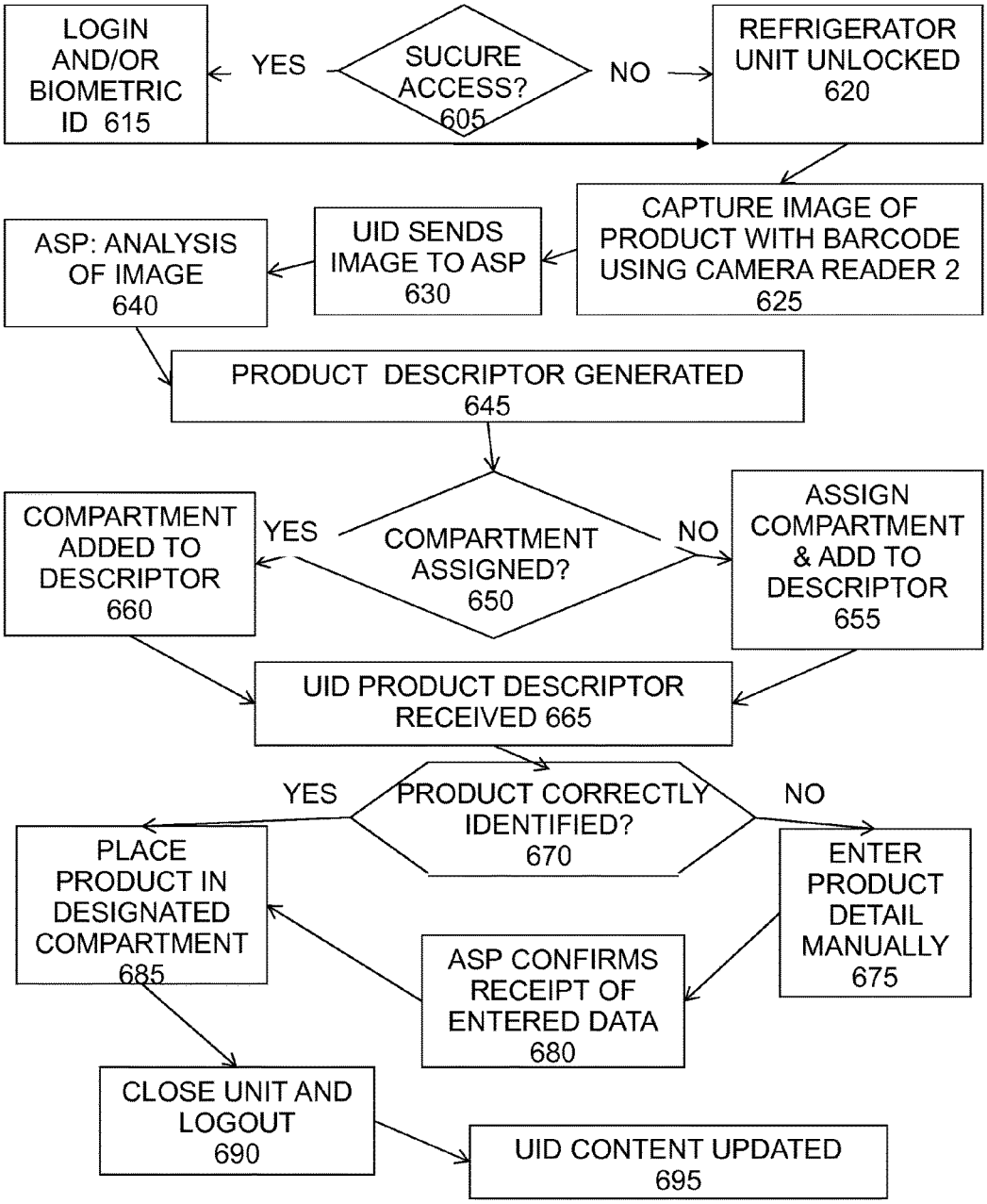
FIG. 6 is a flow diagram illustrating steps of an exemplary product intake process using external camera reader 2.

An ASP inventory management function includes the tracking of add/dispense transactions of product to and from the unit. FIG. 6 provides an exemplary protocol flow diagram for addition of product to the unit using a camera as the reader device. An on-site user logs into (step 615) or directly accesses (step 620) the unit via the UID and scans the product using a reader device on the unit (step 625), for example a camera embedded in the UID. The camera reader in communication with the UID send image to the ASP product identification software (step 630) that analyzes the image (step 640) and, using additional manufacturer information stored in its database, generates a product descriptor (step 645) which includes product name, dosage, lot number, expiration date, recommended temperature of storage, and any special handling requirements such as for example light sensitivity. The ASP product management software compares the product descriptor to those of product already in the unit (step 650) and if the product has an assigned compartment in the unit the compartment identifier is included with the product descriptor (step 660). If the product does not have an assigned compartment the ASP product management software will assign one in the temperature zone required for the storage of that product (step 655). The product descriptor and instructions for placement and handling are delivered to the on-site user via the UID where the information is displayed and can be verified by the on-site user (step 665). If any information is missing, for example the expiration date, the on-site user can use the UID keypad to manually enter the information (steps 670, 675, 680). The product is placed in the compartment (step 685), the user logs out (step 690) and the UID product content is updated (step 695). The product descriptor is stored in both the ASP and the UID product database.

Dispensing of product in one embodiment may be captured by the unit when the on-site user selects the product to dispense on the unit content listing, displayed on the UID, and further selects the reason for dispensing including for example: dispense to patient, expired, spoiled in unit, transferred from unit, and discontinued. Optionally the user may also select, or enter manually, the name of the patient to receive the product. The "dispense to patient" reason may be changed to post dispense spoilage if product is deemed to have spoiled prior to being administered to a to patient.

Figure 7:
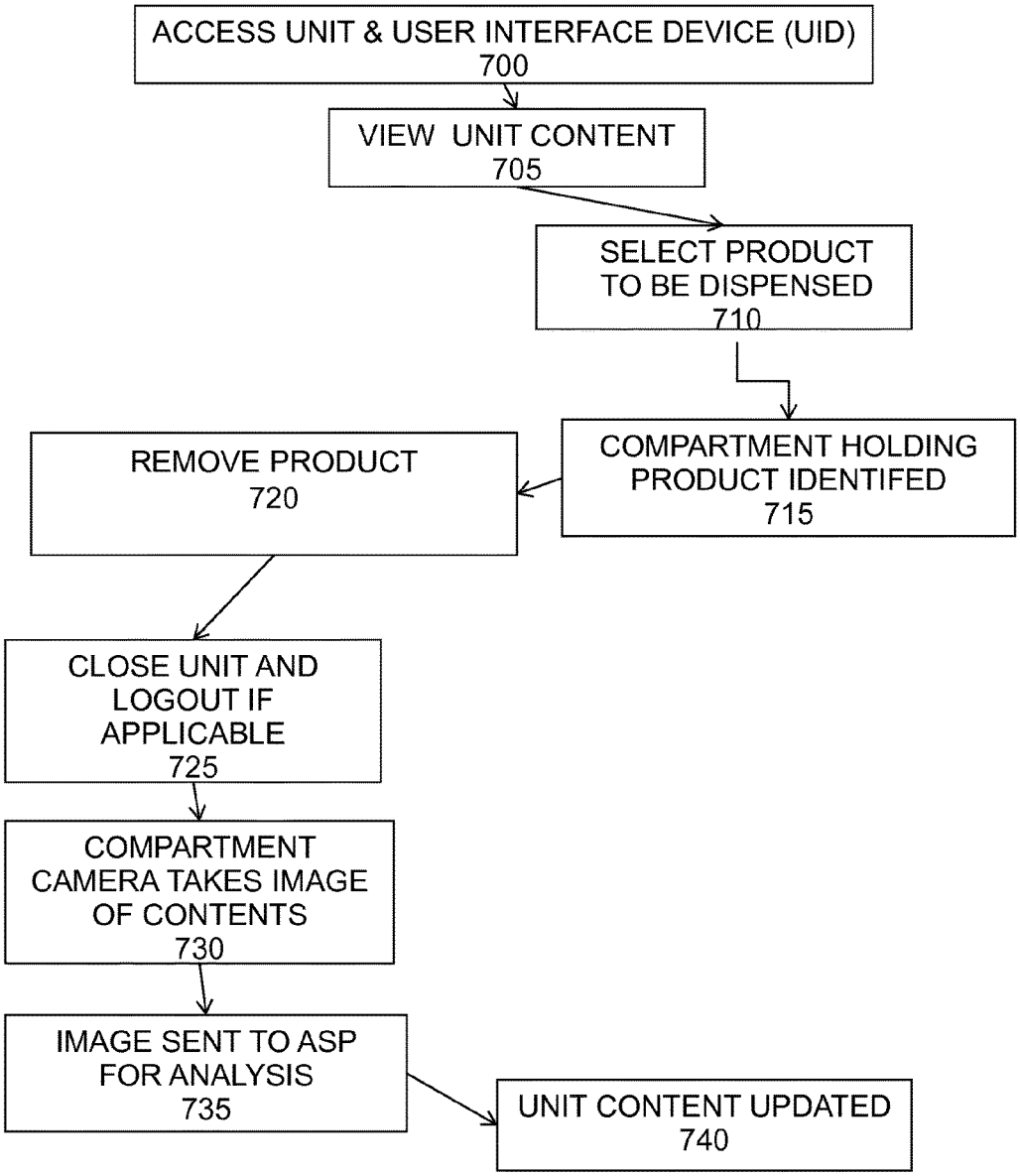
FIG. 7 is a flow diagram illustrating steps of an exemplary product dispense process using internal camera reader 1.

FIG. 7 provides an exemplary protocol flow diagram for dispensing of product from the unit using a camera associated with a compartment as the reader 1 device. An on-site user access the unit and UID (step 700) and views the unit content listing on the UID display (step 705). The compartment holding product is identified (step 715) and the user removes product (step 720) The user logs out and closes unit (step 725). The compartment camera takes and image of the compartment (step 730), the image is sent to the ASP provided software for analysis (step 735), and the unit content is updated (step 740).

Figure 8:
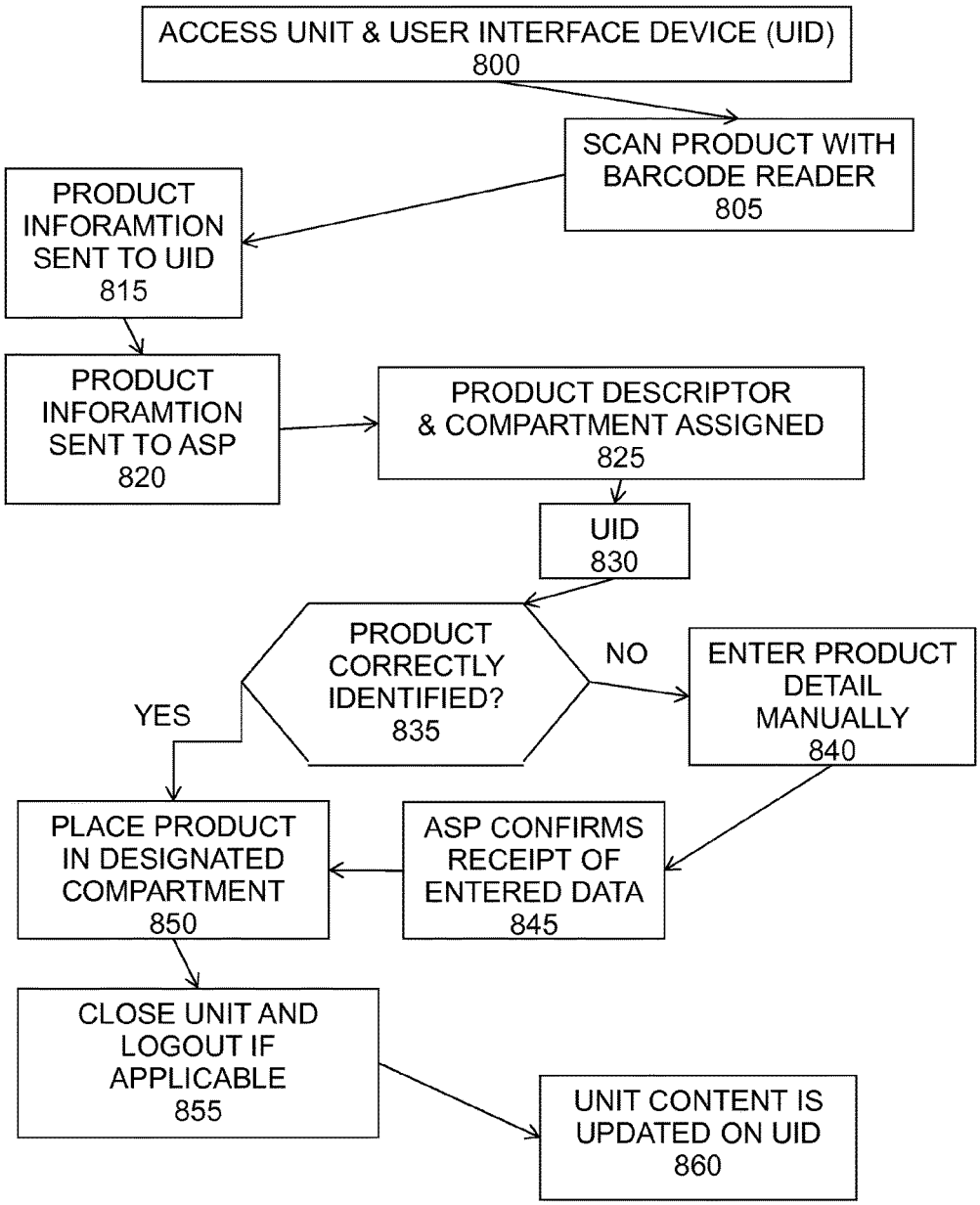
FIG. 8 is a flow diagram illustrating steps of an exemplary product intake process using a barcode reader.

FIG. 8 provides and exemplary protocol for addition of product to the unit using an external barcode reader 2. An on-site user scans the product barcode label with a barcode reader (step 805) and the reader transmits the information to the UID (step 815) which transmits the information to the ASP (step 820) wherein the ASP inventory management software generates a product descriptor with assigned compartment (step 825). The product descriptor is sent to the UID (step 830) and user confirms correct identification of the product (step 835). If product is not correctly identified the user enters information (step 840), ASP software confirms receipt of data and compartment assignment (step 845) and the user places product in the designated compartment (step 850). If the product is correctly identified at step 835 the user places the product in the designated compartment (step 850). The user logs out, closes unit (step 850) and the UID product data base is updated (step 860).

Alerts

Alerting activities will emanate from the ASP hosted system and alerts will be delivered to pre-determined locations including the physical unit and/or specified phones, computers and email addresses. Alerts are generated by events associated with the physical unit including: temperature deviations from allowed temperature range, loss of power to the physical unit in the event of a power outage, lock malfunction, and cooling system failure. Alerts are further generated by the inventory management software based on inventory deviations including expiration of product, about to expire product and low or depleted stock warnings.

Figure 9:
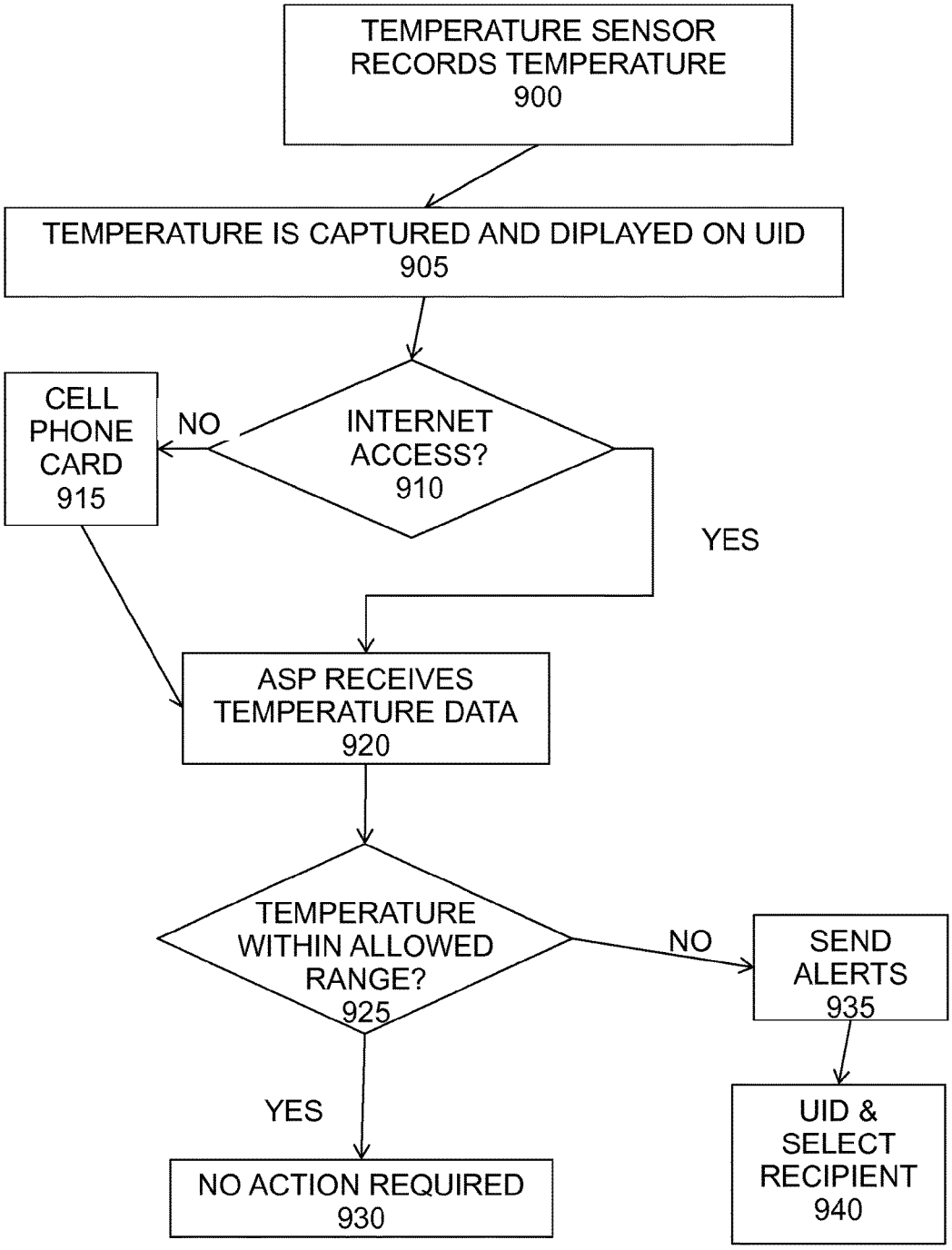
FIG. 9 is a flow diagram illustrating steps performed by the system in generating temperature deviation alert.

The ASP unit management software records and keeps historical data on the temperature of each compartment and the product contained within the compartment. FIG. 9 shows an exemplary flow diagram illustrating the steps taken to monitor temperature and send out alerts. The temperature is, recorded by the temperature sensors associated with each compartment and or temperature zone (step 900) and is sent to and displayed on the UID (step 905). The temperature data is further sent by the UID via the internet (step 910) or a cell phone card (step 915), if internet access is not available, to the ASP unit management software, the temperature data is compared to the allowed storage temperature limits for that product (step 925). If the temperature falls within these limits no action is taken (step 930). If the temperature falls outside these limits an alert is generated (step 935) and delivered to the UID and selected recipients emails and/or phone numbers (step 940). The alert, which may include a visual and/or audio signal, received by the UID will display a temperature deviation warning with name and location of product and instruct the user to confirm the temperature deviation by comparing to temperature readout at the unit, and take action to transfer product to an alternate storage device if necessary. The alert is emailed or telephoned to the customized list of user contacts and includes all information on the nature of the deviation and instruct the recipient to follow user established protocol and take action to confirm product is properly stored.

The ASP database stores expiration date for each product within a unit and generates an alert when a product is within a select number of days from the expiration date or has expired. When a product expires it is critical to remove the product from the unit, not only to comply with TTSPP storage regulation, but to avoid the ultimate error of administering an ineffective product to a patient and endangering the patients well being.

Figure 10:
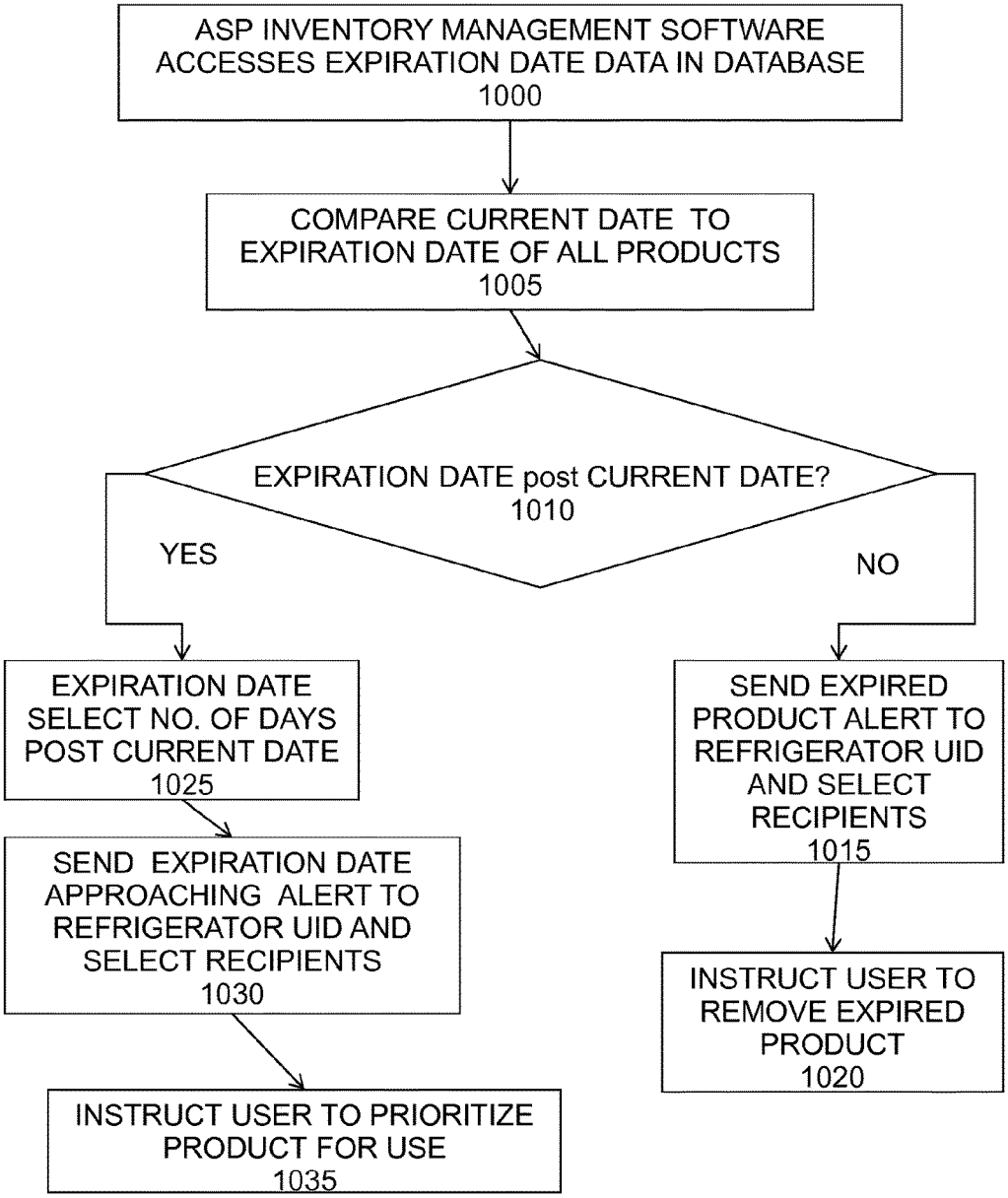
FIG. 10 is a flow diagram illustrating steps performed by the system in generating expiration of product alert.

FIG. 10 shows an exemplary flow diagram illustrating the steps taken to monitor the expiration dates of products and send out alerts. The ASP inventory management software accesses expiration date data in database (step 1000), comparing current date to expiration date (step 1010). If the expiration date is equal to or prior to the current date, the product is expired and an alert is sent to the UID and select recipients (step 1015), with optional audio and or visual alerts, instructing user to remove and dispose of expired product, providing product name, expiration date, lot number and unit/compartment location (step 1020). If a product expiration date is a select number of days post current date (step 1025) a different alert is sent to the UID and select users (step 1030), for example instructing the user to prioritize use of the product (step 1035) if products with later expiration dates are also present in the unit and to verify stock status and consider ordering more product. The select number of days post current date is customizable by the unit user and is based on the dispense rate of the product.

Figure 11:
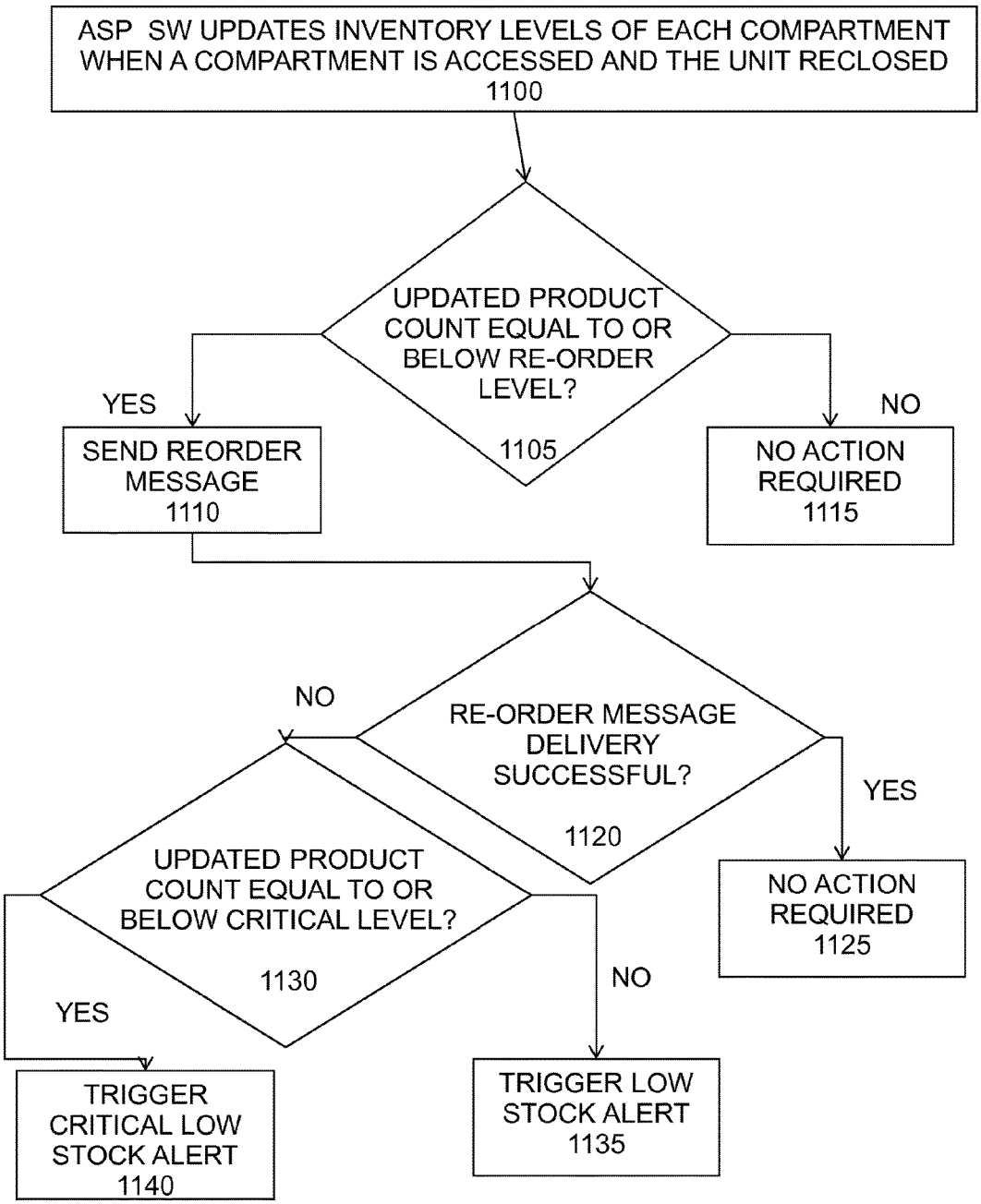
FIG. 11 is a flow diagram illustrating steps performed by the system in generating low stock of product alert.

The ASP inventory management software further sends out low stock alerts and reorder recommendations based on the captured data related to current inventory status of each unit, expiration dates of the products, and pre-determined re-order levels. FIG. 11 shown an exemplary flow diagram illustrating the steps taken to monitor product stock in the unit and send out alerts. The ASP inventory management software updates the inventory levels of each compartment every time a compartment is accessed and the unit is reclosed (step 1100). Inventory is decremented as product is dispensed and upon reaching or falling below a predetermined re-order level (step 1105), an order for additional product will be processed. If product count is greater than the re-order level count (step 1105) no action is required (step 1115). Should inventory levels fall to or below the predetermined re-order level a reorder message is sent (step 1110) to place or confirm if an order has been placed (step 1120). If the re-order message is not successful, an order was not placed, the system will determine if the product count is below a critical level (step 1130) and will generate a low stock alert if it is not below the critical level (step 1135) or a critical low stock alert (step 1140) if it is below the critical level. No action is required (step 1125) if an order is in place. A critical low may occur for a variety of reasons including: expected shipment has been delayed, sudden surge in usage in a single day that reduces inventory past the reorder point, and failure to process a re-order. The quantity of product that is re-ordered is calculated based on the difference between current inventory and the predetermined par level of inventory. The ASP inventory management software can be configured to reorder stock automatically.

Inventory Management

All inventory management functions are managed centrally by the ASP in a cloud based hosted environment. Communication with individual units occurs via the Internet and all authorized users have secure access to their designated units via the ASP website.

The ASP inventory management software captures transactions related to inventory of the refrigerator unit and include stock and dispense transactions with reason for dispending of product. The dispense transactions may include for example: dispensed to patient, expired, spoiled in unit due to unit temperature deviations outside of recommended range, transferred from unit, and discontinued. Post a transaction the "dispensed to patient" transaction may be changed by user to "post dispense spoilage" if product was not administered to patient and product has been deemed to have spoiled. The data is further used to establish historical records of product demand, to ascertain adequate stock is available as needed, avoid loss of product due to expiration/spoilage, and to optimize the frequency and timing for ordering product and the quantity of product to be ordered.

Figure 12:
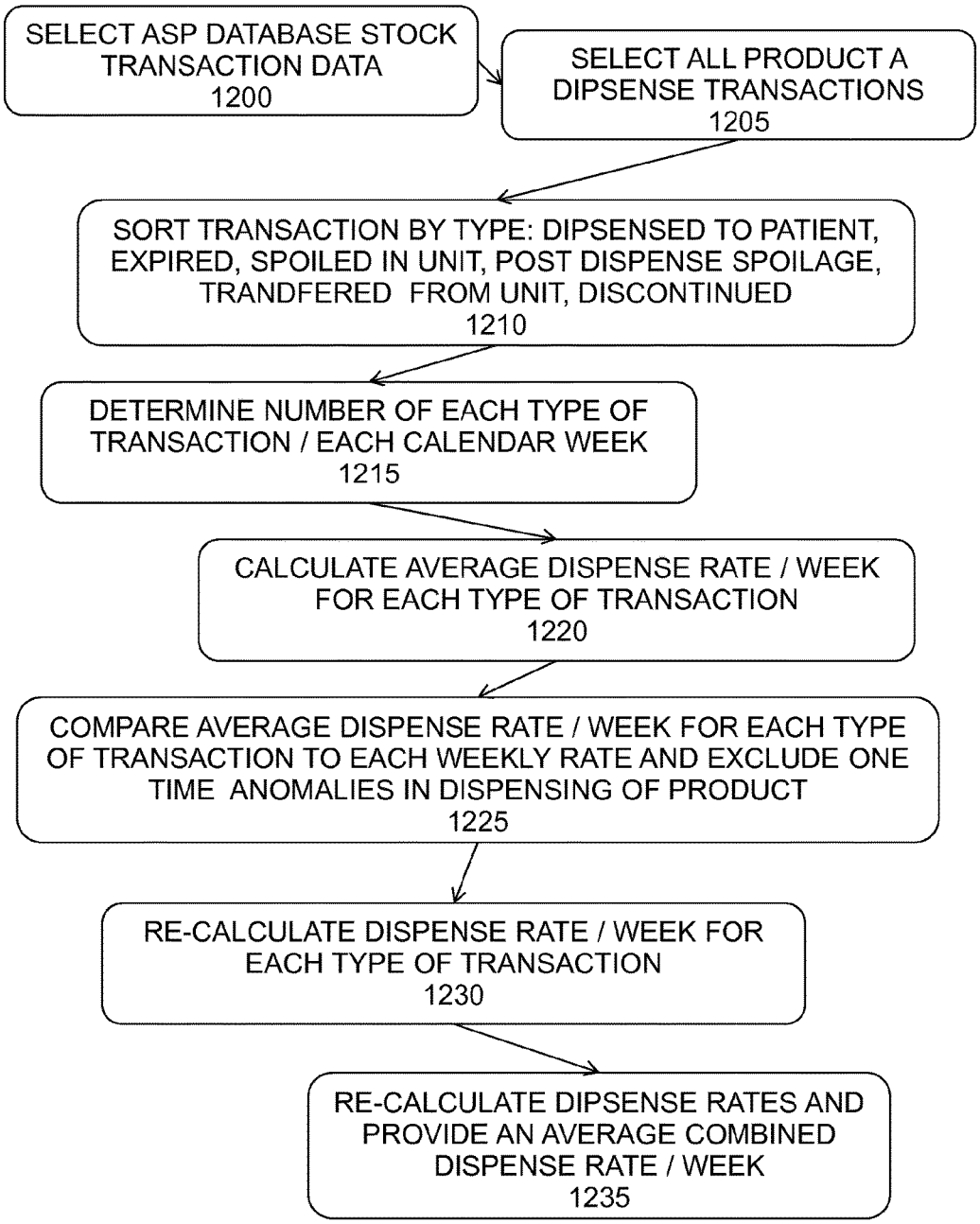
FIG. 12 is a flow diagram illustrating steps performed by the system in determining a product dispense rate.

A product dispense rate is determined by the ASP provided inventory management software to establish historical trends in use of product. Shown in FIG. 12 is an exemplary flow diagram for the process of determining dispense rates of a product. The ASP stored transaction data (step 1200) is first selected for dispensing transaction data (step 1205) which is then sorted by type (step 1210). The dispense rate for each type of dispensing transaction per calendar week (step 1215) and the average weekly rate for each type of dispensing transaction (step 1220) are determined. A comparison is made between the average dispense rate/week for each type of transaction to each weekly rate and one time anomalies in dispensing of product are excluded (step 1225). A corrected average dispense rate/week for each type of transaction is determined (step 1230) and a combined average of dispense rate/week for all transactions is established (step 1235). The exemplary dispense rates above are determined as a weekly rate. Further implementations of the dispense rate may be based on rates calculated for various time segments including a single day, several days, a month or year.

To ascertain a unit does not run out of stock and the optimal quantity of stock is ordered, par levels, re-order levels and critical lows of stock are determined and low stock alert are generated. The determination of the physical maximum inventory level, par level, re-order level and critical low inventory level may be made by an authorized administrator of the unit. Typically, these inventory points will be determined by an individual with access to information and reports on transaction statistics for the unit. As historical trends of product use are established for a specific unit the determination of the par levels may be adjusted to reflect the historical use of the product within a given time period and may also be adjusted for seasonal variations. The unit user may choose to adjust the rates based on their review of the historical transaction data or may request that the ASP provide estimated values as a service.

The quantity of product to be ordered is based on the predetermined par level which is a function of the number of products that can physically fit within the allotted compartments (physical maximum) in the unit, the shelf life of the product, a desired re-order frequency and the dispense rate of the product. For example a product with a shelf life of 90 days (i.e. expiration date is 90 days from the date of manufacture) and a dispense rate of 5 products per 10 days would allow the storage of a maximum of 45 products without having some of the product expire prior to use. Although the unit can physically accommodate 45 product units, the par level may be set significantly lower than 45 in order to have a desired shipment of product every two weeks. In this example, the par level may be set at 15, allowing room for variations in dispenses rate and product delivery. If the unit compartment can only accommodate 10 product units, the maximum par level in this exemplary case is set at 10.

The re-order level is used to trigger a product order. If the order is not placed for whatever reason, there is a chance that the product could completely stock out and reach an inventory count of zero generating a stock-out alert. For example if it takes two days to order and receive product and the current dispense rate for product is 5 per day, a re-order level of 10 would be the lowest product count to trigger re-order. If an order has not been placed and inventory is at or below the set re-order level of 10, a low stock alert will be issued. Further, if the inventory level has reached a predetermined critical low level ( ) a low stock alert would be issued. In keeping with the example, if the critical low level is determined to be 4 (less than a day's supply of product) and that inventory level is reached prior to the new shipment arriving, a low stock alert is issued. Preferably the re-order level will be set at a higher count, for example 20 in this exemplary case, to adjust for delays in placement of order and dispense rate variations.

The authorized user of a unit has access to reports, provided by the ASP inventory management software, HIPPA compliant, that ascertain compliance with regulatory requirements, and allow the user to review and optimize protocols of handling and ordering of product. The reports may include: current inventory of product with expiration dates; quantity of product dispensed, by type of dispensing and/or total dispensed, for a selected time period such as day, week month year; dispense rate and type by date, percentages of product administered and percent product lost due to expiration, spoilage in unit, spoilage outside of unit; alert reports detailing any inventory and/or temperature alerts that have been generated over a given period of time.

An authorized user further has access to reports on regional inventory data available through the ASP database wherein the report may include: type and quantity of product administered by location such as a local region defined by community or city, a state, and/or country within a selected time period; and dispense rate and type by date, percentages of product administered and percent product lost due to expiration, spoilage in unit, spoilage outside of unit. Fluctuating supply demands for time and temperature sensitive pharmaceuticals (TTSPS) give rise to a need for timely communication between the unit user, a point of care provider, manufacturers, distributors, sales representatives and others managing the flow of the TTSPS. The ASP inventory management software provides such a communications network, via a web interface, delivering user profile customized access to reports related to TTSPS inventory transactions. A manufacture of product "A", for example, can have access to product "A" reports. Reports may include: quantity of product administered in by date and/or by location such as a local region defined by community or city, a state, and/or country within a selected time period; percentages of product administered and percent product lost due to expiration, spoilage in unit, spoilage outside of unit for a selected location; number of units within select location or region distributing product "A"; and low stock of product "A" alerts per unit and/or region.

A distributor and/or product representative can have access to reports on products that they distribute and/or represent. Reports may include: quantity of product dispensed to patient by date and/or by location such as a local region defined by community or city, a state, and/or country within a selected time period; percentages of product dispensed to patient and percent product lost due to spoilage or expiration.

Figure 13A:
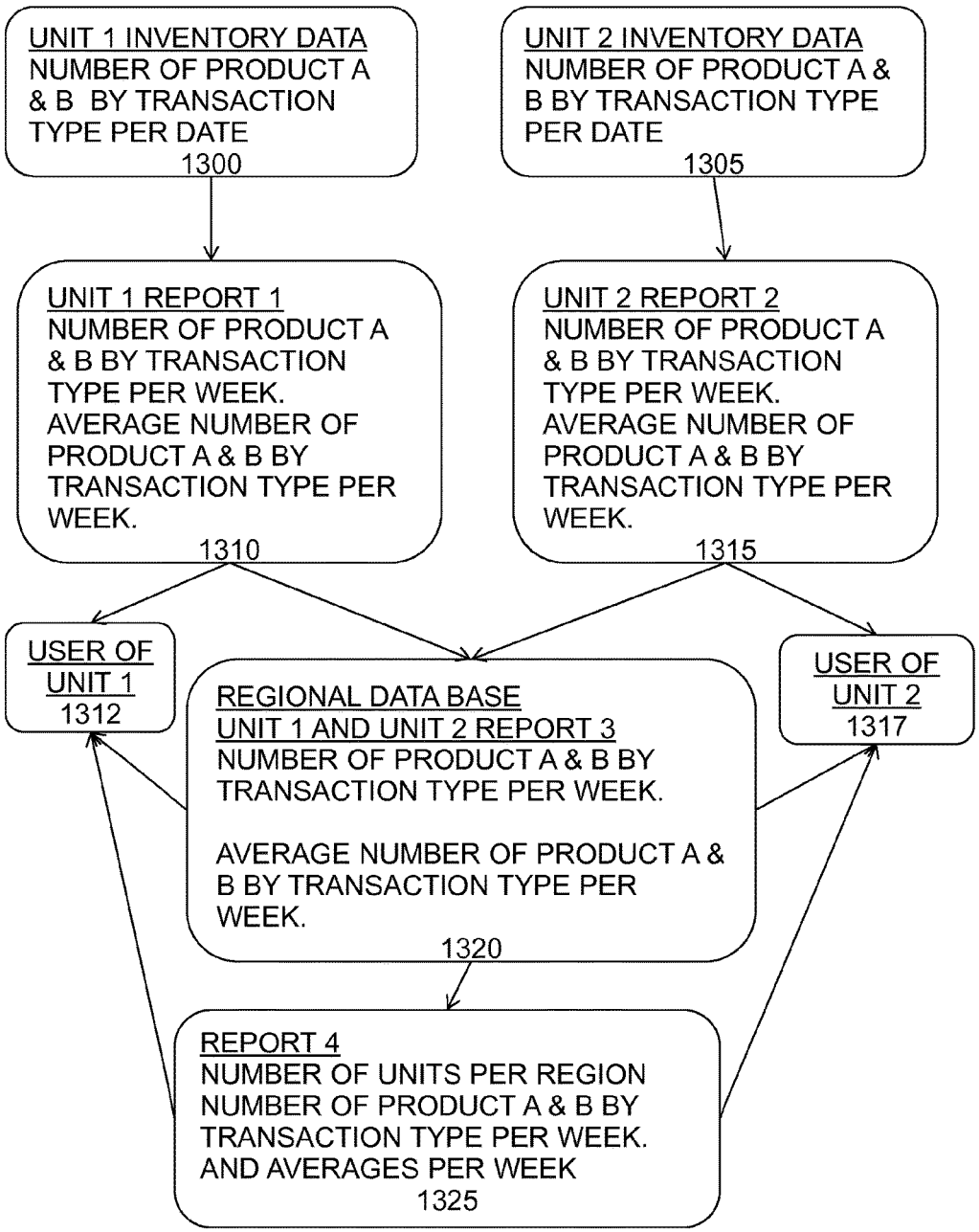
FIGS. 13A and 13B is a flow diagram illustrating access to inventory reports based on user profile.
Figure 13B:
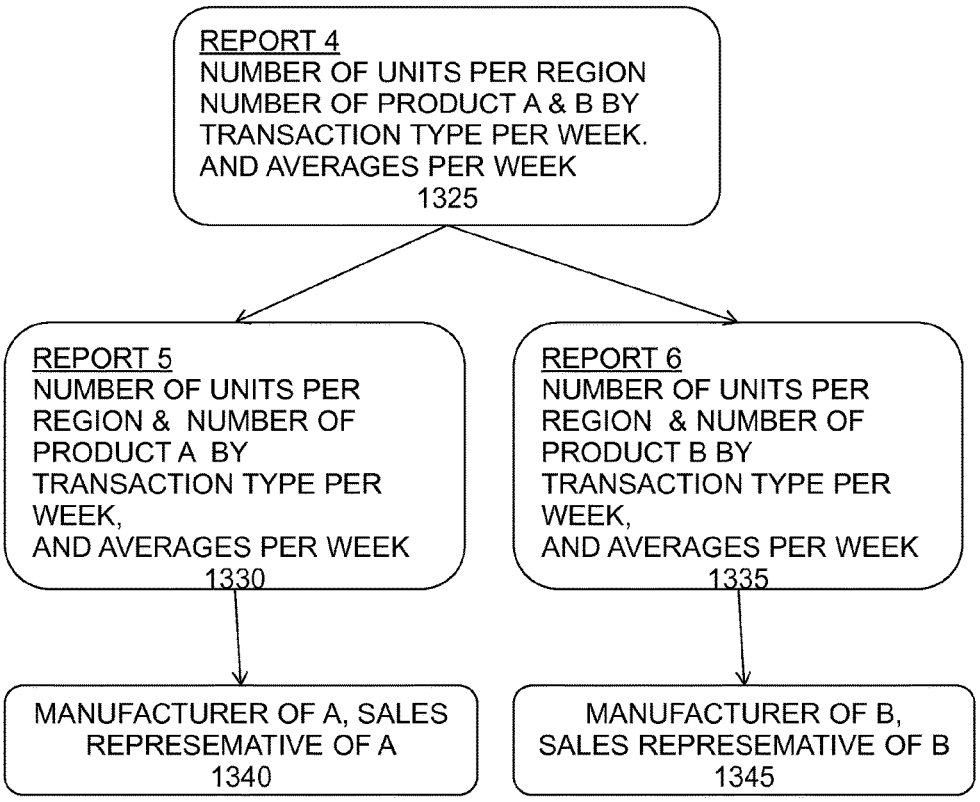

FIG. 13A and FIG. 13B illustrate by way of an example the generation of, and user access to, reports on products A and B based on a time period of one week. Unit 1 and Unit 2 transaction data (steps 1300 and 1305) is used to generate a report for each unit, Unit 1 Report 1 and Unit 2 Report 2 accessible to the unit's users, 1312 and 1317, and includes the number of products stocked or dispensed per week by transaction type. The reports and data are merged in a regional database 1320 and provide unit user, 1312 and 1317, with regional data report, Report 4 1325. The regional data is broken down by product type, Report 5 for exemplary product A, 1330, and Report 6 for exemplary product B 6, 1335, for reporting to for example manufactures and sales representatives, of product A, 1340, and of product B, 1345.

Figure 14:
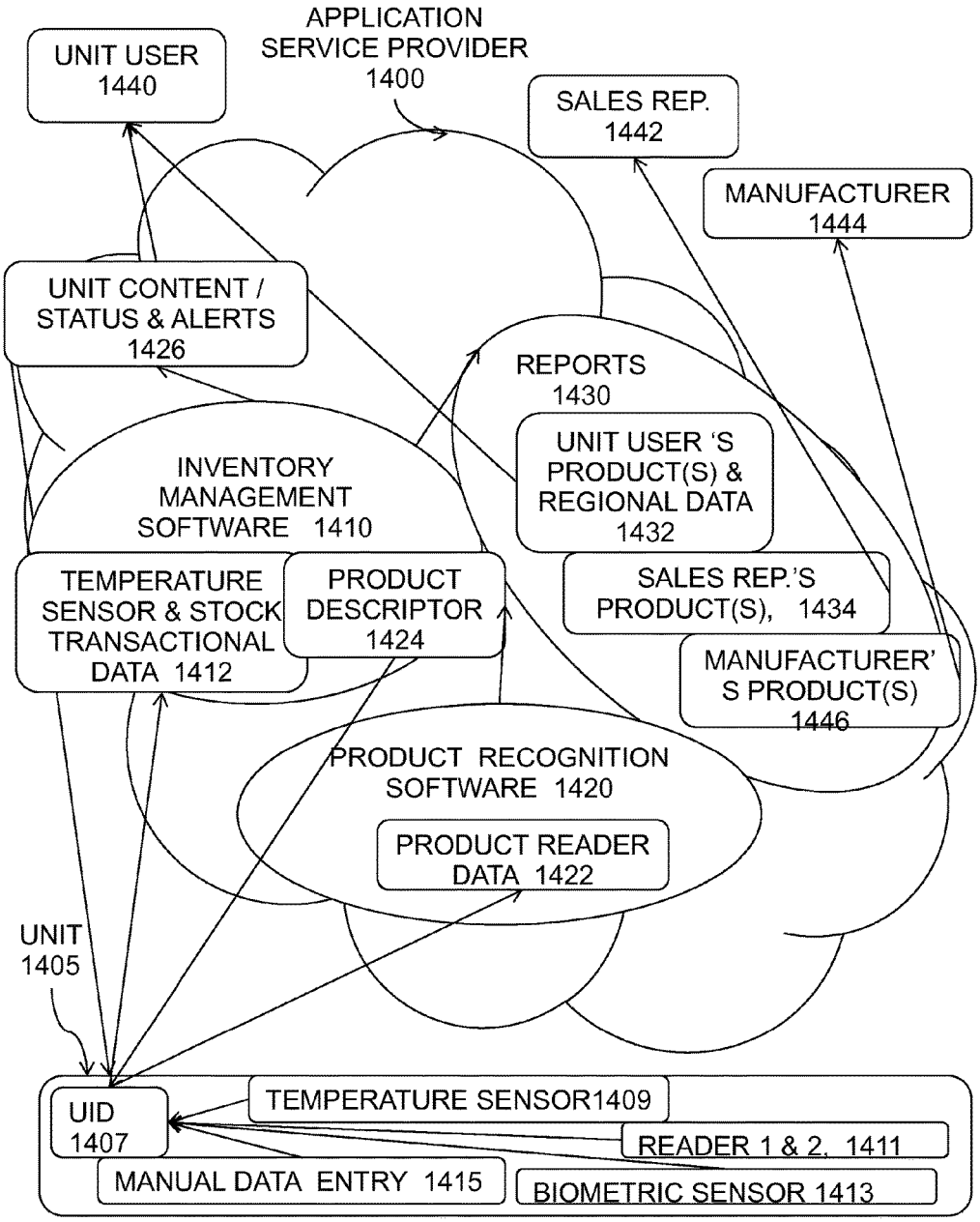
FIG. 14 is a block diagram illustrating the various functions provided by the Application Service Provider.

FIG. 14 illustrates by way of example some of the functions provided by the ASP. The ASP 1400 utilizes the Inventory Management Software 1410 and Product Recognition Software 1420 to capture and analyze data received from the Unit 1405 to generate Reports 1430 made available by report type (1432, 1434, and 1446) to the Unit User 1440, Sales Representative 1442, and Manufacturer 1444. The Unit 1405 UID 1407 captures data from a Temperature Sensor 1409, Readers 1 and 2 1411, Biometric Sensor 1413 and manually entered data 1415. The Product Recognition Software 1420 captures and analyze the Product Reader Data 1422 and generates a Product Identifier 1424 that is used in combination with the Temperature Sensor & Stock/Dispense Data 1412 by the Inventory Management Software 1410 to generate Unit Content/Status and Alerts 1426 also displayed on the UID 1407.

In further embodiments of the ASP provided inventory management software an automatic customizable product order/reorder protocol may be implemented in response to low stock alerts. Re-order messages will be directed to one or more parties depending on customized preferences. These messages for example could flow to a manufacturer, a distributor, a physician's re-ordering system or some combination of two or more. Re-order messages are available in a variety of message formats including, but not limited to, EDI and HL7.

The ASP hosted system will provide an interface to other computer systems that require information directly. A doctor's office may desire an interface to provide dispense data to confirm the product dispensed and/or re-ordering information to process through an existing re-order process. Interface messages are available in a variety of message formats including (but not limited to) EDI and HL7.

Since modifications will be apparent to those of skill in this art, it is intended that this invention be limited only by the scope of the appended claims.

What is claimed is:

1. A smart refrigerator and/or freezer unit for temperature sensitive pharmaceutical products, comprising:

a plurality of location- and temperature-monitored compartments to store temperature sensitive pharmaceutical products in compliance with regulatory requirements and disposed in at least one temperature-controlled temperature zone, wherein each such compartment is associated with at least one temperature sensor, is configured to store a plurality of units of a temperature sensitive pharmaceutical product type, and is maintained at substantially the same temperature as the one or more other compartments in the same temperature-controlled temperature zone; and one or more processors configured for unit operation and to electronically communicate wirelessly or via a hard wire link with an application service provider (ASP).

2. The refrigerator and/or freezer unit of claim 1, wherein the temperature zone comprises a temperature between 2° C. and 8° C. or between −50° C. and −15° C.

3. The smart refrigerator and/or freezer unit of claim 1, wherein temperature zone temperature is monitored by the one or more temperature sensors associated with the temperature-monitored compartments in the temperature zone, and wherein the temperature of each temperature zone is displayed on an external portion of the refrigerator.

4. The smart refrigerator and/or freezer unit of claim 1 that further comprises a backup power supply.

5. The smart refrigerator and/or freezer unit of claim 1 that further comprises a reader, optionally a barcode reader.

6. The smart refrigerator and/or freezer unit of claim 1 that is wirelessly or connected via a hard wire to a computer network, optionally the Internet.

7. The smart refrigerator and/or freezer unit of claim 1 that is in electronic communication with an ASP.

8. The smart refrigerator and/or freezer unit of claim 1, wherein temperature monitoring of the compartments in the at least one temperature zone is continuous.

9. The smart refrigerator and/or freezer unit of claim 1 configured for secure access, optionally via entry of a user login code or biometric data.

10. The smart refrigerator and/or freezer unit of claim 1 that further comprises a touch screen interface configured to receive input from and display information on the unit and its contents.

11. The smart refrigerator and/or freezer unit of claim 10, wherein the information displayed on the touch screen interface comprises one or more of: temperature sensitive pharmaceutical product type name or names; temperature sensitive pharmaceutical product type dosage or dosages; temperature sensitive pharmaceutical product type quantity or quantities in the smart refrigerator and/or freezer unit; nearest temperature sensitive pharmaceutical product expiration date; current temperature of temperature-controlled temperature zone(s); alerts; and temperature sensitive pharmaceutical product type order status.

12. The smart refrigerator and/or freezer unit of claim 10, wherein a user, by selecting the name of a specific temperature sensitive pharmaceutical product type on the touch screen display, is provided further information about the temperature sensitive pharmaceutical product type, which further information is optionally selected from the group consisting of location by compartment and/or temperature zone, temperature history, lot number or numbers with associated expiration date or dates of current inventory of the temperature sensitive pharmaceutical product type, and an Internet link to the temperature sensitive pharmaceutical product type.

13. The smart refrigerator and/or freezer unit of claim 1, wherein each of the plurality of compartments is capable of holding a plurality of units of one temperature sensitive pharmaceutical product type, which units optionally have the same expiration date.

14. The smart refrigerator and/or freezer unit of claim 1, wherein the plurality of compartments holds one temperature sensitive pharmaceutical product unit per temperature-monitored compartment.

15. The smart refrigerator and/or freezer unit of claim 1 that further comprises a plurality of temperature-controlled temperature zones, each of which is optionally maintained at a temperature different from the temperature of the at least one other temperature zone.

16. The smart refrigerator and/or freezer unit of claim 15 that comprises first and second temperature-controlled temperature zones, wherein the first temperature-controlled temperature zone is maintained at a temperature between 2° C. and 8° C. and the second temperature-controlled temperature zone is maintained at a temperature between −50° C. and −15° C.

17. A system to manage temperature sensitive pharmaceutical products, comprising a plurality of smart refrigerator and/or freezer units each connected to an application service provider (ASP), and wherein each of the smart refrigerator and/or freezer units comprises:

a plurality of location- and temperature-monitored compartments to store temperature sensitive pharmaceutical products in compliance with regulatory requirements and disposed in at least one temperature-controlled temperature zone, wherein each such compartment is associated with at least one temperature sensor, is configured to store a plurality of units of a temperature sensitive pharmaceutical product type, and is maintained at substantially the same temperature as the one or more other compartments in the same temperature-controlled temperature zone; and one or more processors configured for unit operation and to electronically communicate wirelessly or via a hard wire link with an application service provider (ASP).

18. A system according to claim 17, wherein the ASP provides one or more services selected from the group consisting of inventory management and system administration.

* * * * *